US009552818B2

(12) United States Patent
Purnhagen et al.

(10) Patent No.: US 9,552,818 B2
(45) Date of Patent: Jan. 24, 2017

(54) SMOOTH CONFIGURATION SWITCHING FOR MULTICHANNEL AUDIO RENDERING BASED ON A VARIABLE NUMBER OF RECEIVED CHANNELS

(71) Applicant: DOLBY INTERNATIONAL AB, Amsterdam Zuidoost (NL)

(72) Inventors: Heiko Purnhagen, Stockholm (SE); Leif Sehlstrom, Stockholm (SE); Karl Jonas Roeden, Stockholm (SE); Kristofer Kjoerling, Stockholm (SE); Lars Villemoes, Stockholm (SE)

(73) Assignee: Dolby International AB, Amsterdam Zuidoost (NL)

( * ) Notice: Subject to any disclaimer, the term of this patent is extended or adjusted under 35 U.S.C. 154(b) by 78 days.

(21) Appl. No.: 14/406,670

(22) PCT Filed: Jun. 14, 2013

(86) PCT No.: PCT/EP2013/062340

§ 371 (c)(1),
(2) Date: Dec. 9, 2014

(87) PCT Pub. No.: WO2013/186344

PCT Pub. Date: Dec. 19, 2013

(65) Prior Publication Data

US 2015/0154970 A1 Jun. 4, 2015

Related U.S. Application Data

(60) Provisional application No. 61/659,602, filed on Jun. 14, 2012, provisional application No. 61/713,025, filed on Oct. 12, 2012.

(51) Int. Cl.
*G10L 19/00* (2013.01)
*G10L 19/008* (2013.01)
(Continued)

(52) U.S. Cl.
CPC ..... *G10L 19/008* (2013.01); *G10L 19/0017* (2013.01); *G10L 19/18* (2013.01);
(Continued)

(58) Field of Classification Search
CPC .. G10L 19/008; G10L 19/087; G10L 21/0224; G10L 21/0232; H04N 21/233; H04N 21/2335
(Continued)

(56) References Cited

U.S. PATENT DOCUMENTS 6,205,430 B1 3/2001 Hui
7,519,538 B2 * 4/2009 Villemoes ..... G10L 21/038 704/205
(Continued)

FOREIGN PATENT DOCUMENTS

CN 1522400 8/2004
CN 102099856 6/2011
(Continued)

OTHER PUBLICATIONS

Herre, J. et al "The Reference Model Architecture for MPEG Spatial Audio Coding" AES Convention Paper, May 1, 2005, 13 pages.
(Continued)

*Primary Examiner* — Daniel Abebe

(57) ABSTRACT

A decoding system reconstructs an n-channel audio signal on the basis of an input signal representing the audio signal, in different time frames, either by parametric coding or as n discretely coded channels. Parametric decoding uses a core signal and mixing parameters controlling a spatial synthesis stage, to which a downmix signal is supplied from a downmix stage. The downmix stage realizes a projection on the downmix signal based on an n-channel input signal, either a discretely coded signal or a core signal padded with neutral-valued channels. The padding may take place either on the
(Continued)

decoding side (reduced parametric coding) or the encoding side. In an embodiment, an audio decoder (110) in the decoding system pads the core signal during an initial portion of each reduced parametrically coded time frame directly succeeding a discretely coded time frame and during a final portion of each reduced parametrically coded time frame directly preceding a discretely coded time frame.

19 Claims, 10 Drawing Sheets

(51) Int. Cl.
*H04S 3/00* (2006.01)
*G10L 19/18* (2013.01)

(52) U.S. Cl.
CPC ..... *H04S 3/008* (2013.01); *H04S 2400/03* (2013.01); *H04S 2420/03* (2013.01)

(58) Field of Classification Search
USPC ..... 704/500
See application file for complete search history.

(56) References Cited

U.S. PATENT DOCUMENTS

| | | | | |
|---|---|---|---|---|
| 7,916,873 | B2 | 3/2011 | Villemoes | |
| 7,987,097 | B2 * | 7/2011 | Pang | G10L 19/008 704/500 |
| 8,082,050 | B2 | 12/2011 | Schmidt | |
| 8,243,936 | B2 | 8/2012 | Henn | |
| 8,577,686 | B2 * | 11/2013 | Oh | H04S 1/007 341/50 |
| 8,793,125 | B2 | 7/2014 | Schuijers | |
| 2004/0158472 | A1 | 8/2004 | Voessing | |
| 2005/0078832 | A1 | 4/2005 | Van De Par et al. | |
| 2007/0092086 | A1 | 4/2007 | Pang | |
| 2007/0203697 | A1 | 8/2007 | Pang | |
| 2008/0205658 | A1 | 8/2008 | Breebaart | |
| 2009/0216544 | A1 * | 8/2009 | Villemoes | G10L 21/038 704/503 |
| 2009/0326931 | A1 * | 12/2009 | Ragot | G10L 19/24 704/220 |
| 2010/0023335 | A1 | 1/2010 | Szczerba | |
| 2010/0305956 | A1 * | 12/2010 | Oh | G10L 19/008 704/500 |
| 2011/0096932 | A1 | 4/2011 | Schuijers | |
| 2011/0129092 | A1 | 6/2011 | Virette | |
| 2011/0173008 | A1 | 7/2011 | Lecomte | |
| 2011/0173009 | A1 | 7/2011 | Fuchs | |
| 2011/0238425 | A1 | 9/2011 | Neuendorf | |
| 2012/0002818 | A1 | 1/2012 | Heiko | |
| 2013/0144631 | A1 | 6/2013 | Miyasaka | |

FOREIGN PATENT DOCUMENTS

| | | |
|---|---|---|
| IN | 2440/CHENP/2006 | 12/2011 |
| JP | 2011-528129 | 11/2011 |
| WO | 2005/055203 | 6/2005 |
| WO | 2007/049861 | 5/2007 |
| WO | 2010/097748 | 9/2010 |
| WO | 2010/149700 | 12/2010 |
| WO | 2011/029570 | 3/2011 |
| WO | 2011/128138 | 10/2011 |
| WO | 2012/020090 | 2/2012 |

OTHER PUBLICATIONS

Neuendorf, M. et al., "MPEG Unified Speech and Audio Coding—The ISO/MPEG Standard for High-Efficiency Audio Coding for All Content Types," AES Convention 132, Apr. 2012, AES New York, USA, Apr. 26, 2012, pp. 1-22.0.

"Digital cellular telecommunications system (Phase 2+); Universal Mobile Telecommunications System (UMTS); LTE; General audio codec audio processing functions; Enhanced aacPlus general audio codec; General description (3GPP TS 26.401 version 10.0.0 Release 10)," Technical Specification, European Telecommunications Standards Institute (ETSI), France, vol. 3GPP SA 4, No. V10.0.0, Apr. 1, 2011, pp. 1-14.

Anonymous, "Study on ISO/IEC 23003-3:201x/DIS of the Unified Speech and Audio Coding," IEEE, LIS, Sophia Antipolis Cedex, France, No. N12013, Apr. 22, 2011, pp. 1-274.

Sheng, C. et al., "A Low Complexity Spatial Parameter Codec Algorithm in MDCT Domain," Computer Science and Service System (CSSS), 2011 International Conference, Jun. 27-29, 2011, pp. 2881-2884.

Suresh, K. et al., "Parametric Stereo Coder with Only MDCT Domain Computations," Signal Processing and Information Technology (ISSPIT), 2009 IEEE International Symposium, Dec. 14-17, 2009, pp. 61-64.

Breebaart, J. et al., "Parametric Coding of Stereo Audio," Journal EURASIP Journal on Applied Signal Processing Archive vol. 2005, Hindawi Publishing Corporation, New York, NY, Jan. 1, 2005, pp. 1-20.

* cited by examiner

SMOOTH CONFIGURATION SWITCHING FOR MULTICHANNEL AUDIO RENDERING BASED ON A VARIABLE NUMBER OF RECEIVED CHANNELS

TECHNICAL FIELD

The invention disclosed herein generally relates to audiovisual media distribution. In particular it relates to an adaptive distribution format enabling both a higher-bitrate and a lower-bitrate mode as well as seamless mode transitions during decoding. The invention further relates to methods and devices for encoding and decoding signals in accordance with the distribution format.

BACKGROUND

Parametric stereo and multichannel coding methods are known to be scalable and efficient in terms of listening quality, which makes them particularly attractive in low bitrate applications. In cases where the bitrate limitations are of a transitory nature (e.g., network jitter, load variations), however, the full benefit of the available network resources may be obtained through the use of an adaptive distribution format, wherein a relatively higher bitrate is used during normal conditions and a lower bitrate when the network functions poorly. Existing adaptive distribution formats and the associated (de)coding techniques may be improved from the point of view of their bandwidth efficiency, computational efficiency, error resilience, algorithmic delay and further, in audiovisual media distribution, as to how noticeable a bitrate switching event is to a person enjoying the decoded media.

BRIEF DESCRIPTION OF THE DRAWINGS

Embodiments of the invention will now be described with reference to the accompanying drawings, on which.

All the figures are schematic and generally only show parts which are necessary in order to elucidate the invention, whereas other parts may be omitted or merely suggested. Unless otherwise indicated, like reference numerals refer to like parts in different figures.

DESCRIPTION OF EXAMPLE EMBODIMENTS

I. Overview

Figure 1:
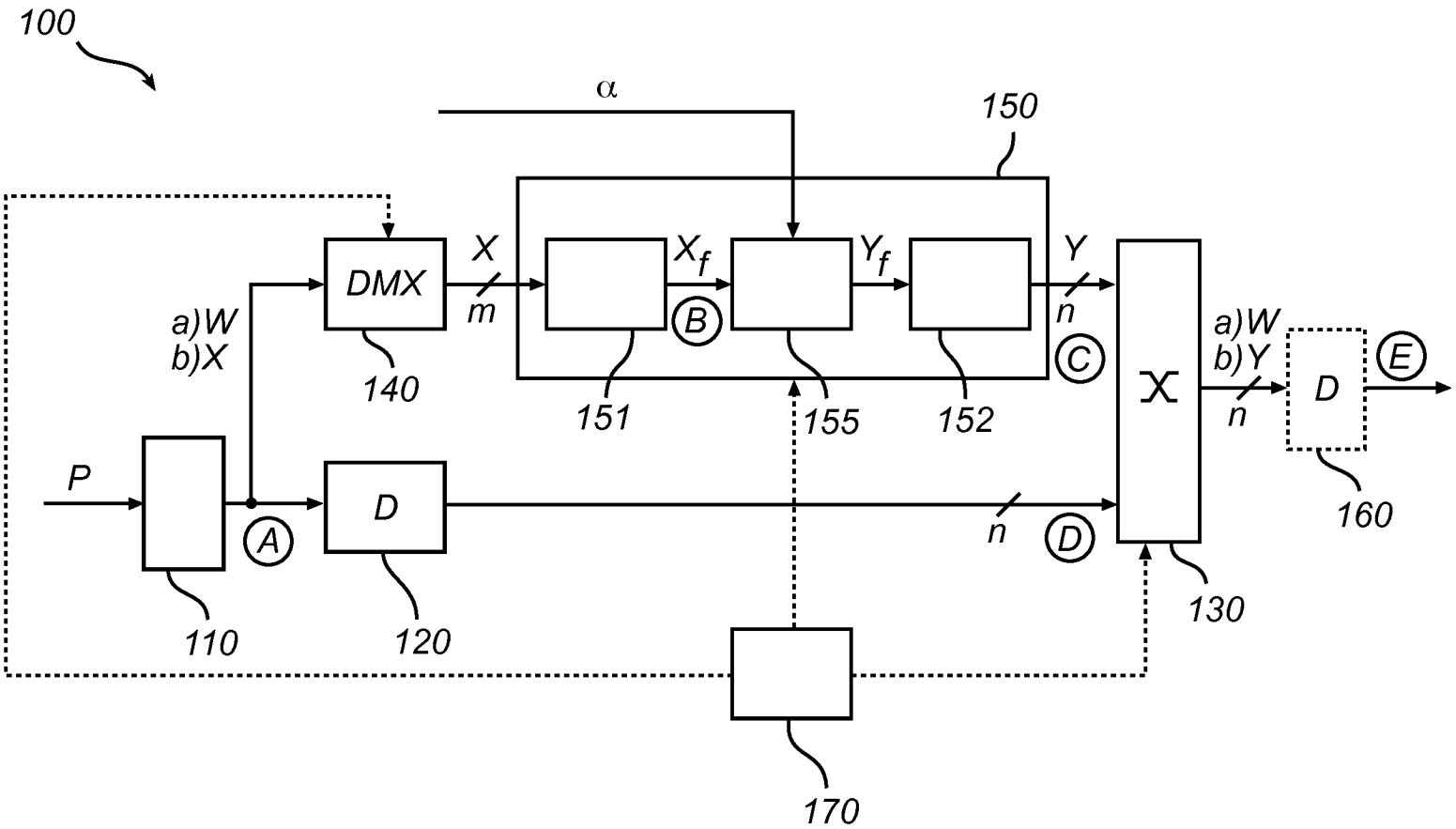
FIG. 1 is a generalized block diagram of a decoding system in accordance with an example embodiment of the invention.

As used herein, an audio signal may be a pure audio signal, an audio part of an audiovisual signal or multimedia signal or any of these in combination with metadata.

Within a first aspect of the present invention, an example embodiment proposes methods and devices enabling adaptive distribution of media content, such as audio or video content, with improved bitrate selection abilities and/or reduced delay. An example embodiment further provides a coding format suitable for such adaptive media distribution, which contributes to seamless transitions between bitrates.

Example embodiments of the invention provide an encoding method, encoding system, decoding method, decoding system, audio distribution system, and computer-program product with the features set forth in the independent claims.

A decoding system is adapted to reconstruct an audio signal on the basis of an input signal, which may be provided to the decoding system directly or may alternatively be encoded by a bitstream received by the decoding system. The input signal is segmented into time frames corresponding to (overlapping or contiguous) time segments of the audio signal. One time frame of the input signal represents a time segment of the audio signal according to a coding regime selected from a group of coding regimes including parametric coding and discrete coding. In particular, if the encoded audio signal is an n-channel signal, the input signal contains (at least) an equal number of channels in received frames where it is discretely coded, i.e., in the discrete coding regime, n discretely encoded channels are used to represent the audio signal. In parametrically coded received frames, the input signal comprises fewer than n channels (although it may be in n-channel format, with some channels unused) but may in addition include metadata, such as at least one mixing parameter derived from the audio signal during an encoding process, e.g., by computing signal energy values or correlation coefficients. Alternatively, the at least one mixing parameter may be supplied to the decoding system through a different communication path, e.g., via a metadata bitstream separate from the bitstream carrying the input signal. As noted, the input signal may be in at least two different regimes (i.e., parametric coding or discrete coding), to which the decoding system reacts by transitioning to—or remaining in—a parametric mode or a discrete mode. The transition of the system may have finite time duration, so that the decoding system enters the mode occasioned by the current coding regime of the input signal only after one or more time frames have elapsed. In operation, therefore, the modes of the decoding system may lag behind the regimes of the input signal by a period corresponding to one or more time frames. An episode of parametrically coded time frames refers to a sequence of one or more consecutive time frames all representing the audio signal by parametric coding. Similarly, an episode of discretely coded time frames is a sequence of one or more consecutive time frames with n discretely coded channels. As used herein, a decoding system is in a parametric mode in those time frames in which the decoding system output is produced by spatial synthesis (regardless of the origin of the underlying data) for the greater part of the frame duration; the discrete mode refers to any time frames in which the decoding system is not in the parametric mode.

The decoding system comprises a downmix stage adapted to output an m-channel downmix signal based on the input signal. Preferably, the decoding system accepts a downmix specification controlling quantitative and/or qualitative aspects of the downmix operations, e.g., gains to be applied in any linear combinations formed by the downmix stage. Preferably, the downmix specification is a data structure susceptible of being provided from a data communication or storage medium to at least one further downmix stage, e.g., a downmix stage with similar or different structural characteristics in an encoder providing the input signal, or a bitstream encoding the input signal, to the decoding system. This way, it may be ensured that these downmix stages are functionally equivalent, e.g., they provide identical downmix signals in response to identical input signals. The loading of a downmix specification may amount to a reconfiguration of the downmix stage after deployment, but may alternatively be performed during its manufacture, initial programming, installation, deployment or the like. The downmix specification may be expressed in terms of a particular form or format of the input signal (including positions or numbering of channels in a format). Alternatively, it may be expressed semantically (including a channel's geometric significance, irrespective of its position relative to a format). Preferably, the downmix specification is formulated independently of the current form or format of the input signal and/or the regime of the input signal, so that the downmix operation may continue past a change of input signal format without interruption.

The decoding system further comprises a spatial synthesis stage adapted to receive the downmix signal and to output an n-channel representation of the audio signal. The spatial synthesis stage is associated with a non-zero pass-through time for reasons of its algorithmic delay; one of the problems underlying the invention is to achieve smooth switching despite the presence of this delay. The n-channel representation of the audio signal may be output as the decoding system output; alternatively, it undergoes additional processing with the general aim of reconstructing the audio signal more faithfully and/or with fewer artefacts and errors. The spatial synthesis stage accepts at least one mixing parameter controlling quantitative and/or qualitative aspects of the spatial synthesis operation. In principle, the spatial synthesis stage is active in at least the parametric mode, e.g., when a downmix signal is available. In the discrete mode, the decoding system derives the output signal from the input signal by decoding each of the n discretely encoded channels.

According to this example embodiment, the downmix stage is active in at least the first time frame (e.g., throughout the entire frame) in each episode of discretely coded time frames and in at least the first time frame (e.g., throughout the entire frame) after each episode of discretely coded time frames. This implies that the m-channel downmix signal may be available as soon as there is a transition in the input signal from discrete to parametric coding. As a consequence, the spatial synthesis stage can be activated in shorter time, even if it includes processing associated with an intrinsic non-zero algorithmic delay, e.g., time-to-frequency transformation, real-to-complex conversion, and/or hybrid analysis filtering. Further, an n-channel representation of the audio signal may stay available throughout transitions from parametric mode to discrete mode and may be used to make such transitions faster and/or less noticeable.

As used herein, a time frame (or frame) is the smallest unit of the input signal for which the coding regime can be controlled. Preferably, non-empty channels of the input signal are obtained by a windowed transform. E.g., each transform window may be associated with a sample and consecutive transform windows may overlap, as in MDCT. Clearly, if consecutive windows overlap by 50%, the length of a time frame is not smaller than the half-length of a transform window (e.g., the half-length of a 512-sample transform window is equivalent to 256 samples), which is then equal to the transform stride. Because the switching events can be made less perceptible to a person enjoying the decoded audio, this example embodiment need not limit the number of switching events during operation, but may respond attentively to changes in network conditions. This permits available network resources to be utilized more fully. A reduced decoding system delay may enhance the fidelity of the media, particularly in live media streaming.

For the purposes of this disclosure, by the downmix stage being active in a time frame, it is meant that the downmix stage is active at least during a subset of the time frame. The downmix stage may be active throughout/during an entire frame or only during a subset of the time frame, such as the initial portion of the frames. The initial portion may correspond to ½, ⅓, ¼, ⅙ of the frame length; the initial portion may correspond to the transform stride; alternatively, the initial portion may correspond to T/p, where T is the frame length and p is the number of transform windows that begin in each frame. A transition between coding regimes in the input signal typically involves a cross-fade in the beginning of a time frame (e.g., during the first ⅙ of the time frame or during 256 time samples out of 1536), between the coding of the previous time frame and the coding of the current time frame (e.g. as a result of using overlapping transform windows when transforming the input signal from a frequency-domain format in which it may be obtained from a bitstream, into the time-domain). The downmix stage may preferably be active during at least the initial portion of the time frame directly after a transition to or from discrete coding of the input signal. This makes the downmix signal available during the cross-fade in the input signal, whereby the spatial synthesis stage may output an n-channel representation of the audio signal for portions of time frames associated with cross-fade in the input signal. Information about the current regime of the input signal (e.g., parametric coding or discrete coding) may be received together with the input signal, e.g., a bit at a certain position in a bitstream in which the input signal is contained. For example, during parametric coding, information about spatial parameters may be found in certain positions of the bitstream while during discrete coding these positions/bits are not used. By checking the presence of such bits in their expected positions, the decoding system may determine the current coding regime of the input signal.

In a further development of the preceding example embodiment, a time segment of the input signal may represent a time segment of the audio signal by a coding regime selected from a group of coding regimes including parametric coding, discrete coding and reduced parametric coding. Thus, in the further development, there is an additional coding regime referred to as reduced parametric coding, in which the input signal is an m-channel core signal (possibly accompanied by mixing parameters and other metadata). This core signal is obtainable from a hypothetical discrete n-channel input signal representing the same audio signal (i.e., representing an audio signal which is identical to the audio signal first referred to) by means of downmixing in accordance with the downmix specification. Conversely, based on the input signal in discretely coded time frames, the downmix specification enables to determine what the core signal would have been if reduced parametric coding had been used to represent the same audio signal in those frames.

In frames where the input signal represents the audio signal by reduced parametric coding, there may be no need for performing any downmix. Indeed, the input signal is an m-channel core signal and need not be downmixed before it is sent to the spatial synthesis stage. Hence, the spatial synthesis stage may preferably receive the input signal directly, or the input signal may pass through the downmix stage unaffected before reaching the spatial synthesis stage. In frames where the input signal represents the audio signal by reduced parametric coding, the spatial synthesis stage may therefore output an n-channel representation of the audio signal based on the input signal and at least one mixing parameter. Deactivating the downmix stage (or putting it in idle/passive/rest mode) when receiving reduced parametrically coded time frames, may save energy whereby e.g., battery time in a portable device may be extended.

In an example embodiment, the downmix stage is active in each time frame in which the input signal represents the audio signal by parametric coding. In examples where there are only two coding regimes (parametric and discrete), this implies that the downmix stage is active in at least all frames which are not discretely coded. In examples where there are additional coding regimes available, such as reduced parametric coding, the downmix stage may be inactive/deactivated/idle also in time frames which are not discretely coded. This may save energy and/or extend battery time.

In an example embodiment the decoding system is adapted to receive an input signal which during parametrically coded time frames comprises an m-channel core signal (in addition to any mixing parameters and other metadata). The core signal is obtainable from a hypothetical discrete n-channel input signal representing the same audio signal (i.e., representing an audio signal which is identical to the audio signal first referred to) by means of downmixing in accordance with the downmix specification. Conversely, based on the input signal in discretely coded time frames, the downmix specification enables to determine what the core signal would have been if parametric coding had been used to represent the same audio signal in those frames.

However, because the downmix stage is active in at least some discretely coded time frames (such as the first time frame in an episode of discretely coded time frames) where the input signal may not contain a core signal, the decoding system will be able to predict what this core signal would have been in these discretely coded time frames. Hence, even if there in principle may be no coexistence of a core signal and discretely coded channels, any discontinuities in connection with a regime change (between parametric coding, or reduced parametric coding, and discrete coding) in the input signal may be mitigated or avoided altogether.

In a further development of the preceding example embodiment, the downmix stage is adapted to generate the downmix signal by reproducing the core signal in the input signal if this is available. In other words, the downmix stage is adapted to respond to receipt of a parametrically coded time frame, inter alia, by copying or forwarding the core signal, so that the downmix stage outputs the core signal as the downmix signal. Put differently, if the m channels in the downmix signal are considered as a subspace of the space of n-channel input signals, then the downmix stage is a projection on this subspace. In particular, there is an m-channel subset of the input signal which the downmix stage maps identically to the respective m channels in the downmix signal. This may be stipulated in the downmix specification. For discretely coded time frames, the downmix signal is generated on the basis of the input signal and in accordance with the downmix specification. As discussed above, the downmix specification defines a relationship between the core signal and the n discretely coded channels in the input signal. This implies that a regime change in the input signal cannot in itself give rise to a discontinuity; that is, if the audio signal is continuous across the mode change, the downmix stage output will remain continuous and substantially free from interruptions.

In an example embodiment, which may be effected as an alternative to the example embodiments outlined above or as a further development of these, the decoding system is adapted to receive a bitstream encoding the input signal in a format applicable both in the parametric coding regime and the discrete coding regime. To accommodate the n discretely coded channels, the received bitstream encodes the input signal in a format including n channels or more. As a consequence, time frames in parametric coding regime may contain for example n−m non-used channels. To preserve the uniformity of the format in the parametric coding regime, the non-used channels are present but are set to a neutral value corresponding to no excitation, e.g., a sequence of zeros. The inventors have realized that a decoder product may contain legacy components or generic components (e.g., hardware, algorithms, software libraries) designed without an intention to be deployed in adaptive media distribution equipment, where format changes may be frequent. Such components may respond to a detected change into a lower-bitrate format by deactivating or partially powering themselves off. This may prevent smooth transitions between bitrates or make those more difficult to achieve due to discontinuities in connection with format changes, when the components revert to normal operation. Difficulties may also arise when contributions from frames in different coding regimes are summed, such as in connection with a transform with overlapping window functions. In the present example embodiment, because a uniform format is used for the input format, components with these characteristics in the decoding system will typically remain substantially unaffected by a transition from the parametric to the discrete coding regime and vice versa. The above holds true for all discretely or parametrically coded time frames. In some example embodiments, the input signal may instead be provided in m-channel format (reduced parametric coding regime) between two episodes of parametrically coded time frames, so as to remove a need for downmixing when no mode transition is imminent or being carried out. Optionally, an m-channel format (i.e. reduced parametric coding regime) may be used in all frames not discretely coded, and the decoding system may optionally be adapted to reformat the received m-channel format into n-channel format in at least some frames. For example, in reduced parametrically coded frames directly preceding, or directly succeeding discretely coded time frames, the reduced parametric coding may be reformatted by appending n−m neutral channels to the m-channel format, in order to obtain at least some of the above described advantages of having the same number of channels during transitions between different coding regimes. Preferably, the uniform format accommodates mixing parameters and other metadata for use in the parametric and/or discrete mode. Preferably, the input signal is encoded by entropy coding or similar approaches, so that the non-used channels will increase the required bandwidth only to a limited extent.

In an example embodiment, the decoding system further comprises a first delay line and a mixer. The first delay line receives the input signal and is operable to output a delayed version of the input signal. Alternatively, the first delay line may be operable to delay a processed version of the input signal, e.g., after the n channels have been derived from the input signal, or after de-packetization. The first delay line need not be active in the parametric mode (i.e., in those time frames in which the decoding system output is produced by spatial synthesis), possibly with the exception of an initial time frame in a sequence of time frames in which the decoding system is in discrete mode, to facilitate a mode transition. The mixer is connected both to the first delay line output and to the spatial synthesis stage output and acts as a selector between these two sources. In the parametric mode, the mixer outputs the spatial synthesis stage output. In the discrete mode, the mixer outputs the first delay line output. When there is a transition between discrete and parametric (or reduced parametric, if the decoding system is adapted to reformat received reduced parametrically coded time frames into n-channel format, as described above) coding regimes in the input signal, the mixer performs a mixing transition between the two outputs. The mixing transition may include a cross-fade-type operation or other mixing transition known to be not very perceptible. The mixing transition may occupy a time frame or a fraction of a time frame from which the mode transition takes place. The presence of the first delay line allows the n-channel representation of the audio signal provided by the spatial synthesis stage to remain in synchronicity with the signal derived on the basis of the n discretely encoded channels from the input signal. This furthers the smoothness of a mode transition. Further, the mixer will be able to transition between the modes with short latency, since there is no need for preliminary alignment of the two signals. In particular, the first delay line may be configured to delay the input signal by a period corresponding to a total pass-through time of the downmix stage and the spatial synthesis stage. The total pass-through time may be the sum of the respective pass-through times. However, the total pass-through time may be less than the sum if delay reduction measures are taken. It is noted that the pass-through time of the downmix stage may be a non-zero number or zero, particularly if the downmix stage operates in the time domain.

In a further development of the preceding embodiment, the decoding system further includes a second delay line downstream of the mixer. The second delay line is configured to function similarly in parametric mode and discrete mode, namely by adding a delay being the difference between a time frame duration and the delay incurred by the first delay line. Hence, the total pass-through time of the decoding system is exactly one time frame. Alternatively, the delay incurred by the second delay line is chosen such that the total delay incurred by the first and second delay lines corresponds to a multiple of the length of one time frame. Both these alternatives simplify switching. In particular, this simplifies the cooperation between the decoding system and connected entities in connection with switching.

In an example embodiment, the spatial synthesis stage is adapted to apply mixing parameter values obtained by time interpolation. In the parametric and reduced parametric coding regimes, the time frames may carry mixing parameter(s) which are explicitly defined for a reference point (or anchor point) in a given time frame, such as the midpoint or the end of the time frame. Based on the explicitly defined values, the spatial synthesis stage derives intermediate mixing parameter values for intermediate points in time by interpolation between respective reference points in consecutive (contiguous) time frames. In other words, interpolation may only be carried out between two consecutive (contiguous) time frames in case each of these two time frames carries a mixing parameter value, e.g., in case each of the time frames is either parametrically coded or reduced parametrically coded. In this setting, and particularly if the reference point is non-initial, the spatial synthesis stage is adapted to respond to the current time frame being the first time frame in an episode of time frames in which episode each time frame is either parametrically coded or reduced parametrically coded (i.e. the time frame preceding the current time frame does not carry mixing parameter values) by extrapolating the mixing parameter values backward from the reference point in the current time frame up to the beginning of the current time frame. The spatial synthesis stage may be configured to extrapolate the mixing parameters by constant values. This is to say, the mixing parameters will be taken to have their reference-point value at the beginning of the frame, will maintain this value (as an intermediate value) without variation up to the reference point, and will then initiate interpolation towards the reference point in the subsequent time frame. Preferably, the extrapolation may be accompanied by a transition into parametric mode in the decoding system. The spatial synthesis unit may be activated in the current time frame. During the current frame and/or the frame thereafter, the decoding system may transition into reconstructing the audio signal using the n-channel representation of the audio signal output from the spatial synthesis unit. The spatial synthesis stage may be adapted to perform forward extrapolation (of mixing parameter values) from a reference point in the time frame directly preceding the current time frame, when the current time frame is the first time frame in an episode of discretely coded time frames. The forward extrapolation may be achieved by keeping the mixing parameter values constant from the last reference point up to the end of the current time frame. Alternatively, the extrapolation may proceed for one further time frame after the current time frame, so as to accommodate a mode transition into the discrete mode. As a consequence, the spatial synthesis stage may use mixing parameter values extrapolated from one time frame (time frame directly preceding the current time frame) in combination with a core signal from the current time frame (or a subsequent time frame). During the frame after the current frame and/or the time frame thereafter, the decoding system may preferably transition into deriving the audio signal on the basis of the n discretely encoded channels contained in the input signal.

In an example embodiment, the spatial synthesis stage includes a mixing matrix operating on a frequency-domain representation of the downmix signal. The mixing matrix may be operable to perform an m-to-n upmix. To this end, the spatial synthesis stage further comprises, upstream of the mixing matrix, a time-to-frequency transform stage and, downstream of the mixing matrix, a frequency-to-time transform stage. Additionally or alternatively, the mixing matrix is configured to generate its n output channels by a linear combination including the m downmix channels. The linear combination may preferably include decorrelated versions of at least some of the downmix channels. The mixing matrix accepts the mixing parameters and reacts by adjusting at least one gain, relating to at least one of the downmix channels, in the linear combination in accordance with the values of the mixing parameters. The at least one gain may be applied to one or more of the channels in the m-channel frequency-domain representation of the downmix signal. A point change in a mixing parameter value may result in an immediate or gradual gain change; for instance, a gradual change may be achieved by interpolation between consecutive frames, as outlined above. It is noted that the controllability of the gains may be practised regardless of whether the upmix operation is carried out on a time-domain or frequency-domain representation of the downmix signal.

In an example embodiment, the downmix stage is adapted to operate on a time-domain representation of the input signal. More precisely, to produce the m-channel downmix signal, the downmix stage is supplied with a time-domain representation of the core signal or the n discretely encoded signals. Downmixing in the time domain is a computationally lean technique, which in typical use cases implies that operation of the downmix stage will increase the total computational load in the decoding system to a very little extent (compared to a decoder without a downmix stage). As already described, the quantitative properties of the downmixing are controllable by the downmix specification. In particular, the downmix specification may include the gains to be applied.

In an example embodiment, the spatial synthesis stage and the mixer, if such is provided in the decoding system, are controlled by a controller which may be implemented, e.g., as a finite state machine (FSM). The downmix stage may operate independently of the controller or it may be deactivated by the controller when downmix is not needed, e.g., when the input signal is reduced parametrically coded or when the input signal is discretely coded in a current and one (or more) previous time frame. The controller (e.g., finite state machine) may be a processor, the state of which is uniquely determined by the coding types/regimes (parametric, discrete, and if it is available, reduced parametric) of the current time frame and a previous time frame and, possibly, the time frame before the previous time frame as well. As will be seen below, the controller need not include a stack, implicit state variables or an internal memory storing anything but the program instructions in order to be able to practice the invention. This affords simplicity, transparency (e.g., in validation and testing) and/or robustness.

In an example embodiment, the audio signal may be represented, in each time frame, in accordance with the three coding regimes: discrete coding (D), parametric coding (P) and reduced parametric coding (rP). In the current example embodiment (in which the decoding system is not adapted to reformat reduced parametrically coded time frames into n-channel format, which it may be in other example embodiments as described above), the following sequence of consecutive (contiguous) time frames may be avoided:

rP D or D rP, i.e., discretely coded time frames are not (directly) followed or (directly) preceded by reduced parametrically coded time frames. In other words, a discretely coded time frame is followed by either a discretely coded time frame or a parametrically coded time frame, and a discretely coded time frame is preceded by either a discretely coded time frame or a parametrically coded time frame. Alternatively or additionally, the following sequences of consecutive (contiguous) time frames:

P rP P and P rP . . . rP P is preferred over:

P P P and P P . . . P P, respectively, for reasons of coding efficiency. In other words, each time frame following directly after a parametrically coded time frame may preferably be either reduced parametrically coded or discretely coded. An exception to this may be an implementation where very short episodes are accepted; in such circumstances, there may not always be enough time to enter the reduced parametric coding regime, whereby two consecutive parametrically coded time frames may occur.

In an example embodiment, in which the rules described above, relating to the order of time frames coded according to different regimes, are all applied, sequences of time frames in the input signal typically look like D D P D D D D P rP rP rP rP rP P D D D D P D P D D D P rP P D D, where reduced parametric coding (rP) always separates discrete coding (D) and parametric (P) coding. It is to be noted that, as described above, encoding systems of at least some of the example embodiments described above, may be adapted to receive other combinations of (codling regimes of) consecutive frames.

In an example embodiment, decoding proceeds by deriving the n discretely encoded channels from the input signal in all cases where the input signal is discretely coded in a current time frame and in two previous time frames immediately before the current one. Additionally, decoding proceeds by generating an m-channel downmix signal based on the input signal in accordance with a downmix specification where the audio signal is parametrically coded in a current time frame or the current time frame being the first time frame in an episode of discretely coded time frames, and by generating an n-channel representation of the audio signal based on the downmix signal in all cases where the audio signal is parametrically coded in the current frame and in the two previous ones. The behaviour in a time frame where the input signal is parametrically coded (or reduced parametrically coded) in a current and only one previous time frame may differ between different example embodiments. Optionally, the m-channel downmix signal is generated also when the audio signal is parametrically coded in the time frame (immediately) before the previous time frame.

In a further development of this example embodiment, receiving the input signal (e.g., by decoding the bitstream) representing the audio signal, in a given time frame, either by parametric coding or reduced parametric coding, comprises receiving a value of the at least one mixing parameter for a non-initial point in the given time frame. If the current time frame is the first time frame in an episode of time frames in which episode each time frame is either parametrically coded or reduced parametrically coded, the received value of the at least one mixing parameter is backward extrapolated up to the beginning of the current time frame. Additionally, or alternatively, the receipt of two consecutive discretely coded time frames (the current and the previous) after a parametrically coded time frame causes the decoding system to carry out parametric decoding (i.e., generating an n-channel representation of the audio signal based on the downmix signal), however based on a mixing parameter value associated with the time frame preceding the previous time frame. Since there is no immediately subsequent time frame that could form a basis for forward interpolation, the decoding system extrapolates the last explicit mixing parameter value forward throughout the current frame. Meanwhile, the decoding system transitions into discrete decoding/mode, e.g., by performing cross mixing over an initial portion of the frame (e.g., ⅓, ¼ or ⅙ of its duration, the length of which has been discussed above). The method may further comprise the following step: in response to the input signal being parametrically coded in the current time frame and the previous time frame and discretely coded in the time frame preceding the previous time frame, transitioning during the current time frame into generating an n-channel representation of the audio signal based on the downmix signal and at least one mixing parameter.

In an example embodiment of the present invention, an encoding system is adapted to encode an n-channel audio signal segmented into time frames. The encoding system is adapted to output a bitstream (P) representing the audio signal, in a given time frame, according to a coding regime selected from the group comprising: parametric coding and discrete coding using n discretely encoded channels. The encoding system comprises a selector adapted to select, for a given time frame, which encoding regime is to be used to represent the audio signal. The encoding system further comprises a parametric analysis stage operable to output, based on an n-channel representation of the audio signal and in accordance with a downmix specification, a core signal and at least one mixing parameter, which are to form part of the output bitstream in parametric coding. In a further development of the present example embodiment, the group of coding regimes further comprises reduced parametric coding. In the present embodiment, the parametric coding uses a format with n signal channels, and so does the discrete coding. The reduced parametric coding, on the other hand, uses a format with m signal channels, where $n>m\geq 1$.

Within a second aspect of the present invention, there is provided a decoding system for reconstructing an n-channel audio signal. The decoding system is adapted to receive a bitstream encoding an input signal. The input signal is segmented into time frames and represents the audio signal, in a given time frame, according to a coding regime selected from the group comprising: discrete coding using n discretely encoded channels to represent the audio signal; and reduced parametric coding using an m-channel core signal and at least one mixing parameter to represent the audio signal, wherein $n>m\geq 1$. It is to be noted that the reduced parametric coding regime may for example use metadata such as at least one mixing parameter, in addition to the core signal, to represent the audio signal.

The decoding system of the present example embodiment is operable to derive the audio signal either on the basis of the n discretely encoded channels or by spatial synthesis. The decoding system comprises an audio decoder adapted to transform a frequency-domain representation of the input signal, which it extracts from the bitstream, into a time-domain representation of the input signal. The decoding system further comprises a downmix stage operable to output an m-channel downmix signal based on the time-domain representation of the input signal in accordance with a downmix specification, and a spatial synthesis stage operable to output an n-channel representation of the audio signal based on the downmix signal and at least one mixing parameter (e.g., received in the same bitstream and extracted by the audio decoder, or received separately, e.g., in some other bitstream).

In reduced parametrically coded time frames of the present example embodiment, the frequency-domain representation of the input signal is an m-channel signal (i.e., the core signal), unlike the discretely coded time frames in which the frequency-domain representation of the input signal is an n-channel signal. The audio decoder may be adapted to reformat the frequency-domain representation of the input signal (that is, to modify its format), before transforming it into the time domain, in at least portions of reduced parametrically coded time frames adjacent to discretely coded time frames in order for the frequency-domain representation (and thereby also the time-domain representation) of the input signal in these portions to have the same number of channels as in the discretely coded time frames. The time-domain representations of the input signal having a constant number of channels during transitions between discrete coding and reduced parametric coding (but not necessarily constant during episodes of reduced parametrically coded time frames) may contribute to providing a smooth listening experience also during such transitions. This is achieved by facilitating the transition in decoding/processing sections arranged further downstream in the decoding system. For example, having a constant number of channels may facilitate providing a smooth transition in the time-domain representation of the input signal.

For this purpose, the audio decoder may be adapted to reformat the frequency-domain representation of the input signal, during at least an initial portion of each reduced parametrically coded time frame directly succeeding a discretely coded time frame and for at least a final portion of each reduced parametrically coded time frame directly preceding a discretely coded time frame. The audio decoder is adapted to reformat the frequency-domain representation of the input signal (which is represented by an m-channel core signal in the reduced parametrically coded time frames) at these portions into n-channel format by appending $n-m$ neutral channels to the m-channel core signal. The neutral channels may be channels containing neutral signal values, i.e., values corresponding to no audio content or no excitation, such as zero. In other words, the neutral values may be chosen such that when the content of the neutral channels is added to channels containing an audio signal, the addition by which the audio signal is produced is unaffected by the neutral values (the neutral value plus the non-neutral contribution is equal to the non-neutral contribution) but still well-defined as an operation. In the above described way, the m-channel core signal of the frequency-domain representation of the audio signal in (at least portions of some) reduced parametrically coded time frames may be reformatted by the audio decoder into a format homogenous to the format of the input signal in discretely coded time frames, particularly a format comprising the same number of channels.

According to an example embodiment, the audio decoder may be adapted to perform a frequency-to-time transform using overlapping transform windows, wherein each of the time frames is equivalent to (e.g., has the same length as) the half-length of at least one of the transform windows. In other words, each time frame may correspond to a time period being at least half as long as the time period equivalent to one transform window. As the transform windows are overlapping, there may be overlaps between transform windows from different time frames, and values of the time-domain representation of the input signal in a given time frame, may therefore be based on contributions from a time frames other than the given time frame, e.g., at least a time frame directly preceding or directly succeeding the given time frame.

In an example embodiment, the audio decoder may be adapted to determine, in each reduced parametrically coded time frame directly succeeding a discretely coded time frame, at least one channel of the time-domain representation of the input signal by summing at least a first contribution, from at least one of the neutral channels of the reduced parametrically coded time frame, and a second contribution, from the directly preceding discretely coded time frame. As described in relation to a preceding embodiment, an m-channel core signal represents the input signal (in the frequency domain) in reduced parametrically coded time frames, and the audio decoder may be adapted to append m−n neutral channels to the m-channel core signal in (at least on an initial portion of) reduced parametrically coded time frames directly succeeding discretely coded time frames. An n-channel time-domain representation of the input signal may be obtained in such a reduced parametrically coded time frame by summing, for each of the n channels, contributions from corresponding channels of the preceding discretely coded time frame and the reduced parametrically coded time frame. For each of the m channels corresponding to the m-channel core signal, this may comprise summing a first contribution from a channel of the core signal (from the reduced parametrically coded time frame) and a second contribution from the corresponding channel in the discretely coded time frame. For each of the n−m channels corresponding to the n−m neutral channels, this may correspond to summing a first contribution from one of the neutral channels (i.e. a neutral value such as zero) and a second contribution from the corresponding channel in the preceding discretely coded time frame. In this way, contributions from all the n channels of the discretely coded time frame may be used when forming the time-domain representation for the input signal in the reduced parametrically coded time frame directly succeeding the discretely coded time frame. This may allow for a smoother, and/or less noticeable transition in the time domain representation of the input signal. For example, the contribution from the discretely coded time frame may be allowed to fade out in the n−m channels corresponding to the n−m neutral channels in the reduced parametric coding. This may also facilitate processing/decoding of the input signal in stages/units arranged further downstream in the decoding system in order to achieve an improved (or a smoother) listening experience during transitions between discrete and reduced parametric coding of the input signal.

In an example embodiment, the audio decoder may be adapted to determine, in each discretely coded time frame directly succeeding a parametrically coded time frame, at least one channel of the time-domain representation of the input signal by summing at least a first contribution, from the discretely coded time frame, and a second contribution, from at least one of the neutral channels of the directly preceding reduced parametrically coded time frame. As described in relation to a preceding embodiment, an m-channel core signal represents the input signal (in the frequency domain) in reduced parametrically coded time frames, and the audio decoder may be adapted to append m−n neutral channels to the m-channel core signal in (at least a final portion of) reduced parametrically coded time frames directly preceding discretely coded time frames. An n-channel time-domain representation of the input signal may be obtained in a discretely coded time frame directly succeeding such a reduced parametrically coded time frame by summing, for each of the n channels, contributions from corresponding channels of the discretely coded time frame and the preceding reduced parametrically coded time frame. For each of the m channels corresponding to the m-channel core signal, this may comprise summing a first contribution from the corresponding channel in the discretely coded time frame and a second contribution from the corresponding channel of the core signal (from the reduced parametrically coded time frame). For each of the n−m channels corresponding to the n−m neutral channels, this may correspond to summing a first contribution from the corresponding channel in the discretely coded time frame and a second contribution from the corresponding neutral channel (i.e. a neutral value such as zero) from the preceding reduced parametrically coded time frame. In this way, contributions from the m channels of the core signal in the reduced parametrically coded time frame may be used when forming the time-domain representation for the input signal in the directly succeeding discretely coded time frame, e.g. to let the values of the corresponding channels of the discretely coded time frame fade in during an initial portion of the discretely coded time frame. Moreover, in the remaining n−m channels, the neutral values (e.g. zero) in the channels appended to the m-channel core signal may be used to let the values of the corresponding channels of the discretely coded time frame fade in. In particular, any values remaining in buffers/memory of the audio decoder from earlier discretely coded time frames and relating to the n−m channels (typically) not used during episodes of reduced parametric coding, may be replaced by the neutral values of the appended neutral channels, i.e. may not be allowed to affect the audio output of the encoding system at this later discretely coded time frame. The earlier discretely coded time frames referred to above may potentially be located many time frames before the current discretely coded time frame, i.e. they may be separated from the current discretely coded time frame by many reduced parametrically coded time frames, and may potentially correspond to audio content several seconds or even minutes back in the audio signal represented by the input signal. It may therefore be desirable to avoid using data and/or audio content relating to these earlier discretely coded time frames when decoding the current discretely coded time frame.

The present example embodiment may allow for a smoother, and/or less noticeable transition in the time domain representation of the input signal (caused by a transition from reduce parametric coding to discrete coding). It may also facilitate further processing/decoding of the input signal in stages/units further downstream in the decoding system in order to achieve an improved (or smoother) listening experience during transitions between reduced parametric coding and discrete coding of the input signal.

In an example embodiment, the downmix stage may be adapted to be active in at least the first time frame in each episode of discretely coded time frames and in at least the first time frame after each episode of discretely coded time frames. The downmix stage may preferably be active in initial portion of these time frames, i.e. during transitions to and from discrete coding in the time domain representation for the input signal. It may then provide a downmix signal during these transitions, which may be used to provide an output of the encoding system with an improved (or smoother) listening experience during transitions to and from discrete coding in the input signal.

In an example embodiment, the group of coding regimes may further comprise parametric coding. The decoding system may be adapted to receive a bitstream encoding an input signal comprising, in each time frame in which the input signal represents the audio signal by parametric coding, an m-channel core signal being such that, in each time frame in which the input signal represents the audio signal as n discretely encoded channels, an m-channel core signal representing the same audio signal is obtainable from the input signal using the downmix specification.

In the present example embodiment, the time frames of the input signal received via the bitstream may be coded using any of the three coding regimes: discrete coding, parametric coding and reduced parametric coding. In particular, a time frame coded in any one of these coding regimes may follow after a time frame coded in any one of these coding regimes. The decoding system may be adapted to handle any transition between time frames coded using any of these three coding regimes.

Within the second aspect of the present invention, there is provided a method of reconstructing an n-channel audio signal analogous to (the method performed by) the decoding system described in any of the preceding example embodiments. The method may comprise receiving a bitstream; extracting a frequency-domain representation of the input signal from the bitstream; and in response to the input signal being reduced parametrically coded in a current time frame and discretely coded in a directly preceding time frame, or the input signal being reduced parametrically coded in a current time frame and discretely coded in a directly succeeding time frame, reformatting at least a portion of the current time frame of the frequency-domain representation of the input signal into n-channel format; and transforming the frequency-domain representation of the input signal into a time-domain representation of the input signal. The method may further comprise: in response to the input signal being discretely coded in a current and (one or) two directly preceding time frames, deriving the audio signal on the basis of the n discretely encoded channels; and in response to the input signal being reduced parametrically coded in a current and (one or) two directly preceding time frames, generating an n-channel representation of the audio signal based the core signal and the at least one mixing parameter.

Within the second aspect of the present invention, there is provided an encoding system for encoding an n-channel audio signal segmented into time frames, wherein the encoding system is adapted to output a bitstream representing the audio signal, in a given time frame, according to a coding regime selected from the group comprising: discrete coding using n discretely encoded channels; and reduced parametric coding. The encoding system comprises a selector adapted to select, for a given time frame, which encoding regime is to be used to represent the audio signal; and a parametric analysis stage operable to output, based on an n-channel representation of the audio signal and in accordance with a downmix specification, an m-channel core signal and at least one mixing parameter, which are to be encoded by the output bitstream in the reduced parametric coding regime. Optionally, the encoding system may be operable to output the bitstream representing the audio signal, in a given time frame, also according to a parametric coding regime, and the selector may be adapted to select, for a given time frame, between discrete coding, parametric coding and reduced parametric coding.

Within the second aspect of the present invention, there is provided a method of encoding an n-channel audio signal as a bitstream, the method being analogous to (the methods performed by) the encoding systems of any of the preceding embodiments. The method may comprise: receiving an n-channel representation of the audio signal; selecting a coding regime to be used to represent the audio signal, in a given time frame; in response to a selection to encode the audio signal by reduced parametric coding, forming, based on the n-channel representation of the audio signal and in accordance with a downmix specification, a bitstream encoding an m-channel core signal and at least one mixing parameter; and in response to a selection to encode the audio signal by discrete coding, outputting a bitstream encoding the audio signal by n discretely encoded channels.

Within the second aspect of the present invention, there is provided an audio transmission system comprising an encoding system and a decoding system, according to any of the preceding embodiments of such systems. The systems are communicatively connected and the respective downmix specifications of the encoding system and decoding system are equivalent.

It is to be noted that the coding regimes (discrete coding, parametric coding, and reduced parametric coding) described in relation to embodiments of the second aspect of the present invention are the same coding regimes as described in relation to the first aspect of the present invention, and that additional embodiments of the second aspect of the present invention may be obtained by combining the already described embodiments (or combinations thereof) of the second aspect of the present invention with features from the embodiments described in relation to the first aspect of the present embodiment. In doing so, it is to be noted that for at least some features from embodiments according to the first aspect of the present invention, parametrically coded time frames and reduced parametrically coded time frames may be used interchangeably, i.e. there may be no need to distinguish between these two coding regimes.

Further example embodiments of both aspect of the invention are defined in the dependent claims. It is noted that the invention relates to all combinations of features, even if recited in mutually different claims.

II. Example Embodiments

FIG. 1 illustrates in block-diagram form a decoding system 100 in accordance with an example embodiment of the invention. An audio decoder 110 receives a bitstream P and generates from it, in one or more processing steps, an input signal, denoted by an encircled letter A, representing an n-channel audio signal. As one example, one may use the Dolby Digital Plus format (or Enhanced AC-3) together with an audio decoder 110 adapted thereto. The inner workings of the audio decoder 110 will be discussed in greater detail below. The input signal A is segmented into time frames corresponding to time segments of the audio signal. Preferably, consecutive time frames are contiguous and non-overlapping. The input signal A represents the audio signal, in a given time frame, either (b) by parametric coding or (a) as n discretely encoded channels W. The parametric coding data comprise an m-channel core signal, corresponding to a downmix signal X obtainable by downmixing the audio signal. The parametric coding data received in the input signal A may also include one or more mixing parameters, collectively denoted by $\alpha$, which are associated with the downmix signal X. Alternatively, the at least one mixing parameter $\alpha$ associated with the downmix signal X may be received through a signal separate from the input signal in the same bitstream P or a different bitstream. Information about the current coding regime of the input signal (i.e., parametric coding or discrete coding) may be received in the bitstream P or as a separate signal. In the decoding system shown in FIG. 1, the audio signal has six channels and the core signal has two channels, i.e., m=2 and n=6. In some passages of this disclosure, in order to indicate explicitly that some connection lines are adapted to transmit multi-channel signals, these lines have been provided with a cross line adjacent to the respective number of channels. The input signal A may in the discrete coding regime be a representation of the audio signal as 5.1 surround with channels L (left), R (right) and C (centre), Lfe (low frequency effects), Ls (left surround), Rs (right surround). In parametric coding regime, however, the L and R channels are used to transmit core signal channels L0 (core left) and R0 (core right) in 2.0 stereo.

The decoding system 100 is operable in a discrete mode, in which the decoding system 100 derives the audio signal from the n discretely encoded channels W. The decoding system 100 is also operable in a parametric mode in which the decoding system 100 reconstructs the audio signal from the core signal by performing an upmix operation including spatial synthesis.

A downmix stage 140 receives the input signal and performs a downmix of the input signal in accordance with a downmix specification and outputs an m-channel downmix signal X. In the present embodiment, the downmix stage 140 treats the input signal as an n-channel signal, i.e., if the input signal contains only an m-channel core signal, the input signal is considered having n−m additional channels which are empty/zero. In practice, this may translate to padding the non-occupied channels by neutral values, such as a sequence of zeros. The downmix stage 140 forms an m-channel linear combination of the n input channels and outputs these as the downmix signal X. The downmix specification specifies the gains of this linear combination and is independent of the coding of the input signal, i.e., when the downmix stage 140 is active, it operates independently of the coding of the input signal.

In the present embodiment, when the audio signal is parametrically coded, the downmix stage 140 receives an m-channel core signal with n−m empty channels. The gains of the linear combination specified by the downmix specification are chosen such that, when the audio signal is parametrically coded, the downmix signal X is then the same as the core signal, i.e. the linear combination passes through the core signal. The downmix stage may be modelled as follows:

$$\begin{pmatrix} L_0 \\ R_0 \end{pmatrix} = \begin{pmatrix} 1 & 0 & * & * & * & * \\ 0 & 1 & * & * & * & * \end{pmatrix} (L \quad R \quad C \quad Ls \quad Rs \quad Lfe)^T,$$

where each * symbol denotes an arbitrary entry.

In this example embodiment, the spatial synthesis stage 150 receives the downmix signal X. In the parametric mode, the spatial synthesis stage 150 performs an upmix operation on the downmix signal X using the at least one mixing parameter $\alpha$, and outputs an n-channel representation Y of the audio signal.

The spatial synthesis stage 150 comprises a first transform stage 151 which receives a time-domain representation of the m-channel downmix signal X and outputs, based thereon, a frequency-domain representation $X_f$ of the downmix signal X. An upmix stage 155 receives the frequency-domain representation $X_f$ of the downmix signal X and the at least one mixing parameter $\alpha$. The upmix stage 155 performs the upmix operation and outputs a frequency-domain representation $Y_f$ of the n-channel representation of the audio signal. A second transform stage 152 receives the frequency-domain representation $Y_f$ of the n-channel representation Y of the audio signal and outputs, based thereon, a time-domain representation Y of the n-channel representation of the audio signal as output of the spatial synthesis stage 150.

The decoding system 100 comprises a first delay line 120 receiving the input signal and outputting a delayed version of the input signal. The amount of delay incurred by the first delay line 120 corresponds to a total pass-through time associated with the downmix stage 140 and the spatial synthesis stage 150.

The decoding system 100 further comprises a mixer 130, which is communicatively connected to the spatial synthesis 150 stage and the first delay line 120. In the parametric mode, the mixer receives the n-channel representation Y of the audio signal from the spatial synthesis stage 150 and a delayed version of the input signal from the first delay line 120. The mixer 130 then outputs the n-channel representation Y of the audio signal. In the discrete mode, the mixer 130 receives a delayed version of the n discretely encoded channels W from the delay line 120 and outputs this. When the encoding of the input signal changes between parametric coding and n discretely encoded channels, the mixer 130 outputs a transition between the spatial synthesis stage output and the delay line output.

In some embodiments, the decoding system 100 may further comprise a second delay line 160 receiving the output from the mixer 130 and outputting a delayed version thereof. The sum of the delays incurred by the first delay line 120 and the second delay line 160 may correspond to the length of one time frame or a multiple of time frames.

Optionally, the decoding system 100 may further comprise a controller 170 (which may be implemented as a finite state machine) for controlling the spatial synthesis stage 150 and the mixer 130 on the basis of the coding regime of the audio signal received by the decoding system 100, but not on the basis of memory content, buffers or other stored information. The controller 170 (or finite state machine) controls the spatial synthesis stage 150 and the mixer 130 on the basis of the coding regime of the audio signal in the current time frame as well as the coding in the previous time frame (i.e. the one immediately before the present), but not the signal values therein. The controller 170 may control the spatial synthesis stage 150 and the mixer 130 on the basis, further, of the time frame (immediately) before the previous time frame. The controller 170 may optionally control also the downmix stage 140; with this optional functionality, the downmix stage 140 may be deactivated at times when it is not required, e.g., in reduced parametric coding, when a core signal in a format that suits the spatial synthesis stage 150 can be derived in an immediate fashion—or even copied—from the input signal. The operation of the controller 170 according to different example embodiments is described further below with reference to Tables 1 and 2 as well as FIGS. 6 and 8.

Figure 4:
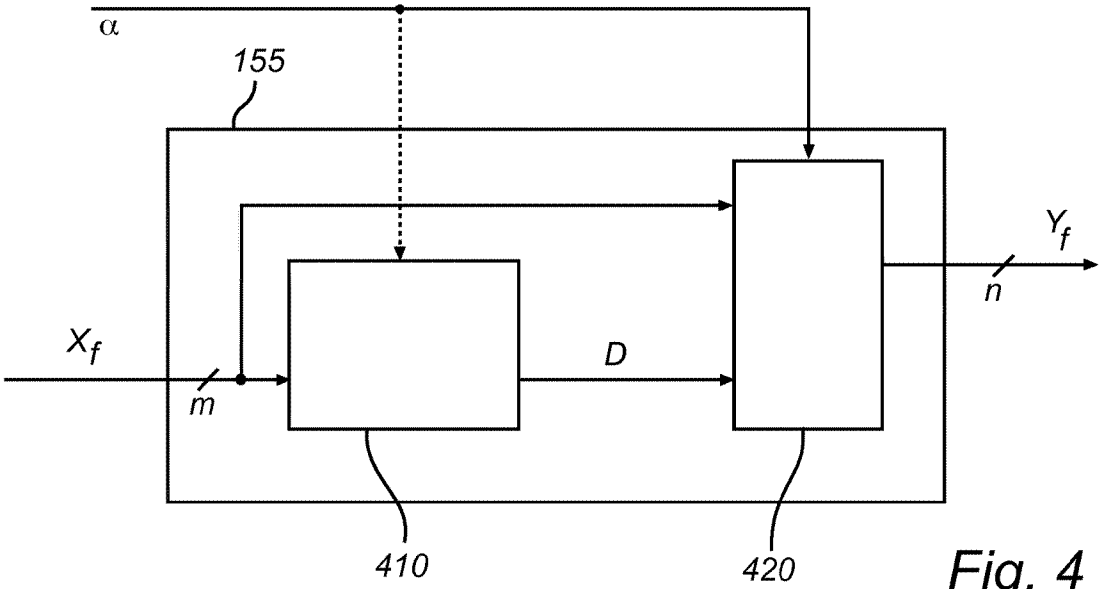
FIG. 4 shows details of an upmix stage according to an example embodiment for deployment in a decoding system.

Referring to FIG. 4, the upmix stage 155 may comprise a downmix modifying processor 410, which in an active state of the upmix stage 155 receives the frequency-domain representation $X_f$ of the downmix signal X and outputs a modified downmix signal D. The modified downmix signal D may be obtained by non-linear processing of the frequency-domain representation $X_f$ of the downmix signal X. For example, the modified downmix signal D may be obtained by first forming new channels as linear combinations of the channels of the frequency-domain representation $X_f$ of the downmix signal X, letting the new channels pass through decorrelators, and finally subjecting the decorrelated channels to artefact attenuation before outputting the result as the modified downmix signal D. The upmix stage 155 may further comprise a mixing matrix 420 receiving the frequency-domain representation $X_f$ of the downmix signal X and the modified downmix signal D, forming an n-channel linear combination of the received downmix signal channels and modified downmix signal channels only and outputting this as the frequency-domain representation $Y_f$ of the n-channel representation Y of the audio signal. The mixing matrix 420 may accept at least one mixing parameter $\alpha$ controlling at least one of the gains of the linear combination formed by the mixing matrix 420. Optionally, the downmix modifying processor 410 may accept the at least one mixing parameter α, which may control the operation of the downmix modifying processor 410.

Figure 2:
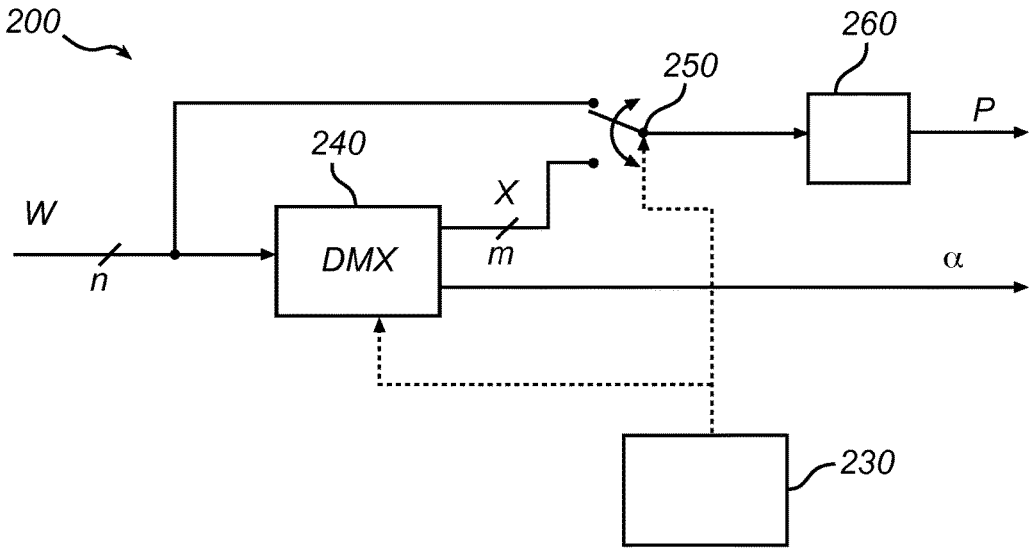
FIG. 2 shows, similarly to FIG. 1, an encoding system in accordance with an example embodiment of the invention.

FIG. 2 illustrates, in block-diagram form, an encoding system 200 in accordance with an example embodiment of the invention. The encoding system 200 receives an n-channel representation W of an n-channel audio signal and generates an output signal P encoding the audio signal.

The encoding system 200 comprises a selector 230 adapted to decide, for a given time frame, whether to encode the audio signal by parametric coding or by n discretely encoded channels. Considering that discrete coding typically achieves higher perceived listening quality at the cost of more bandwidth occupancy, the selector 230 may be configured to base its choice of a coding mode on the momentary amount of downstream bandwidth available for the transmission of the output signal P.

The encoding system 200 comprises a downmix stage 240 which receives the n-channel representation W of the audio signal and which is communicatively connected to the selector 230. When the selector 230 decides that the audio signal is to be coded by parametric coding, the downmix stage 240 performs a downmix operation in accordance with a downmix specification, calculates at least one mixing parameter α and outputs an m-channel downmix signal X and the at least one mixing parameter α.

The encoding system 200 comprises an audio encoder 260. The selector 230 controls, using a switch 250 (symbolizing any hardware- or software-implemented signal selection means), whether the audio encoder 260 receives the n-channel representation W of the n-channel audio signal or whether it receives the downmix signal X (an n-channel signal comprising the m-channel downmix signal X and n−m empty/neutral channels). Alternatively, the encoding system 200 further comprises a combination unit (not shown) receiving the downmix signal X and the at least one mixing parameter α, and outputting, based on these, a combined signal representing the audio signal by parametric coding. In that case, the selector 230 controls, using a switch, whether the audio encoder 260 receives the n-channel representation W of the n-channel audio signal or whether it receives the combined signal. The combination unit may be, e.g., a multiplexer.

The audio encoder 260 encodes the received channels individually and outputs the result as the output signal P. The output signal P may be, e.g., a bitstream.

In an alternative embodiment of the encoding system 200 shown in FIG. 2, the selector 230 is adapted to decide, for a given time frame, whether to encode the audio signal by reduced parametric coding (i.e. using the m-channel downmix signal and not the extra n−m neutral channels appended in parametric coding) or by n discretely encoded channels. The selector 230 is adapted to select, by the switch 250, whether the audio encoder 260 receives the n-channel representation W of the n-channel audio signal or whether it receives the m-channel downmix signal X (without any additional neutral channels).

Figure 9:
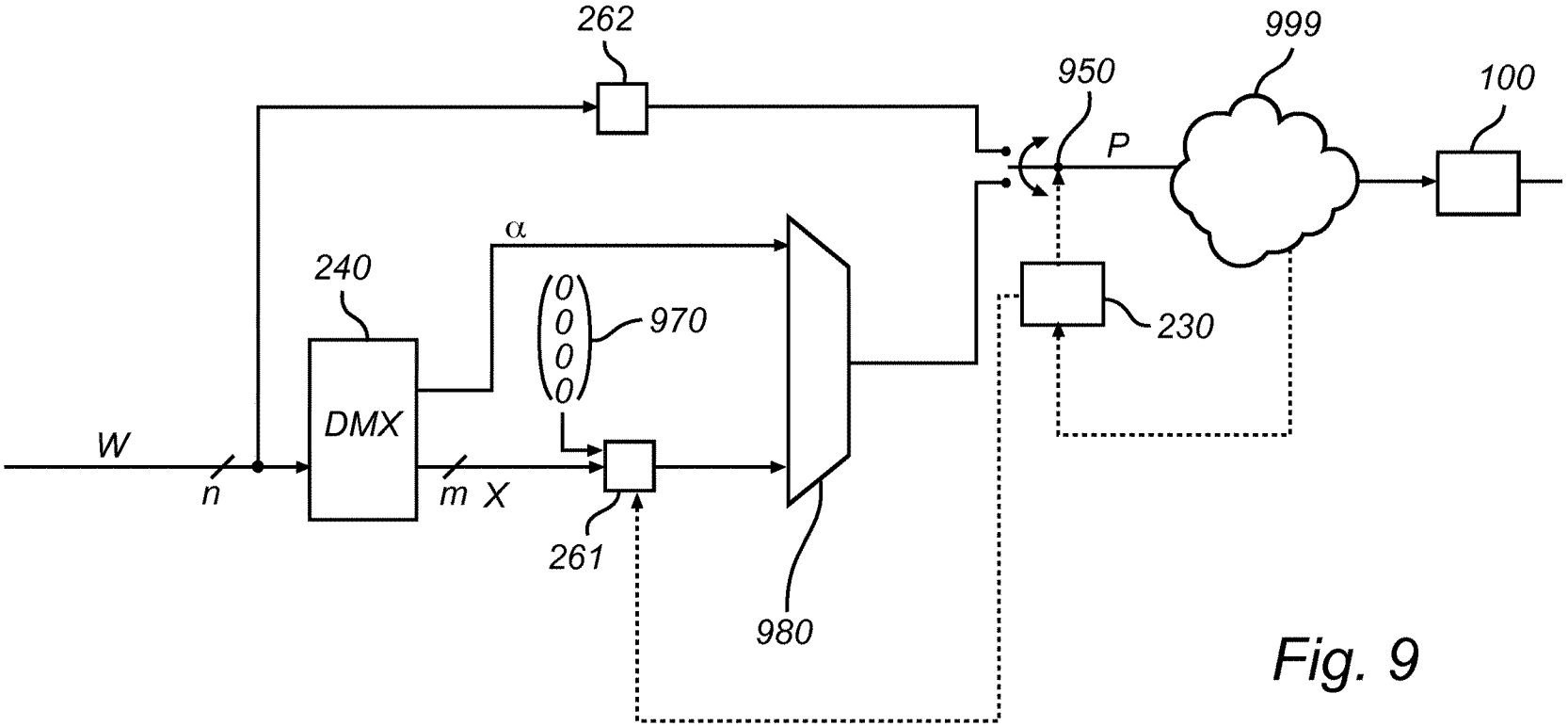
FIG. 9 shows an encoding system transmitting information to a decoder device, in accordance with an example embodiment of the invention.

FIG. 9 illustrates, in block-diagram form, an encoding system in accordance with an example embodiment of the invention. In the present embodiment, n=6 and m=2. The encoding system is shown together with a communication network 999, which connects it to a decoding system 100.

The encoding system receives an n-channel representation W of an n-channel audio signal and generates an output signal P encoding the audio signal. The encoding system comprises a downmix stage 240 which receives the n-channel representation W of the audio signal. The downmix stage 240 performs a downmix operation in accordance with a downmix specification and additionally calculates at least one mixing parameter α and outputs an m-channel downmix signal X and the at least one mixing parameter α.

The encoding system comprises a first audio encoder 261 receiving the downmix signal and n−m empty channels with neutral values 970, i.e. four channels which are present in the format but not used to represent the audio signal. Instead, these channels may be assigned neutral values. The first encoder 261 encodes the received channels individually and outputs the result as an n-channel intermediate signal. The encoding system further comprises a combination unit 980 receiving the intermediate signal and the at least one mixing parameter α, and outputting, based on these, a combined signal representing the audio signal by parametric coding. The combination unit may be, e.g., a multiplexer.

The encoding system comprises a second audio encoder 262 receiving the n-channel representation W of the n-channel audio signal and outputting n discretely encoded channels.

The encoding system further comprises a selector 230 communicatively connected to the communication network 999, through which the output signal P is transmitted before it reaches a decoding system 100. Based on current conditions (e.g., momentary load, available bandwidth etc.) of the network 999, the selector 230 controls, using a switch 950 (symbolizing any hardware- or software-implemented signal selection means), whether the encoding system outputs, in a given time frame, the combined signal or the n discretely encoded channels as the output signal P. The output signal P may be, e.g., a bitstream.

In the present embodiment, as compared to the embodiment described in relation to FIG. 2, the downmix stage 240 may be active independently of the decisions of the selector 230. In fact, the upper and lower portions of the encoding system in FIG. 9 provide the parametric representation of the audio signal, as well as the discrete representation, which may thus be formed in each given time frame independently of the decision on which one to pick for use as output signal P.

In a further development of the encoding system shown in FIG. 9, the first audio encoder 261 is operable to either include the n−m empty channels or to disregard the empty channels. If the first audio encoder 261 is in a mode in which it disregards the channels, it will output an m-channel signal. The combination unit 980 will function similarly to the previous description, that is, it will form a combined signal (e.g., a bitstream) which includes a core signal in m-channel format and the at least one mixing parameter α. The selector 230 may be configured to control the first audio encoder 261 as far as the inclusion or non-inclusion of the n−m empty channels is concerned. Hence, taking the action of the switch 950 into account, the encoding system in FIG. 9 according to this further development may output three different types of bitstreams P. The three types correspond to each of the discrete, parametric and reduced parametric coding regimes described above.

Figure 3:
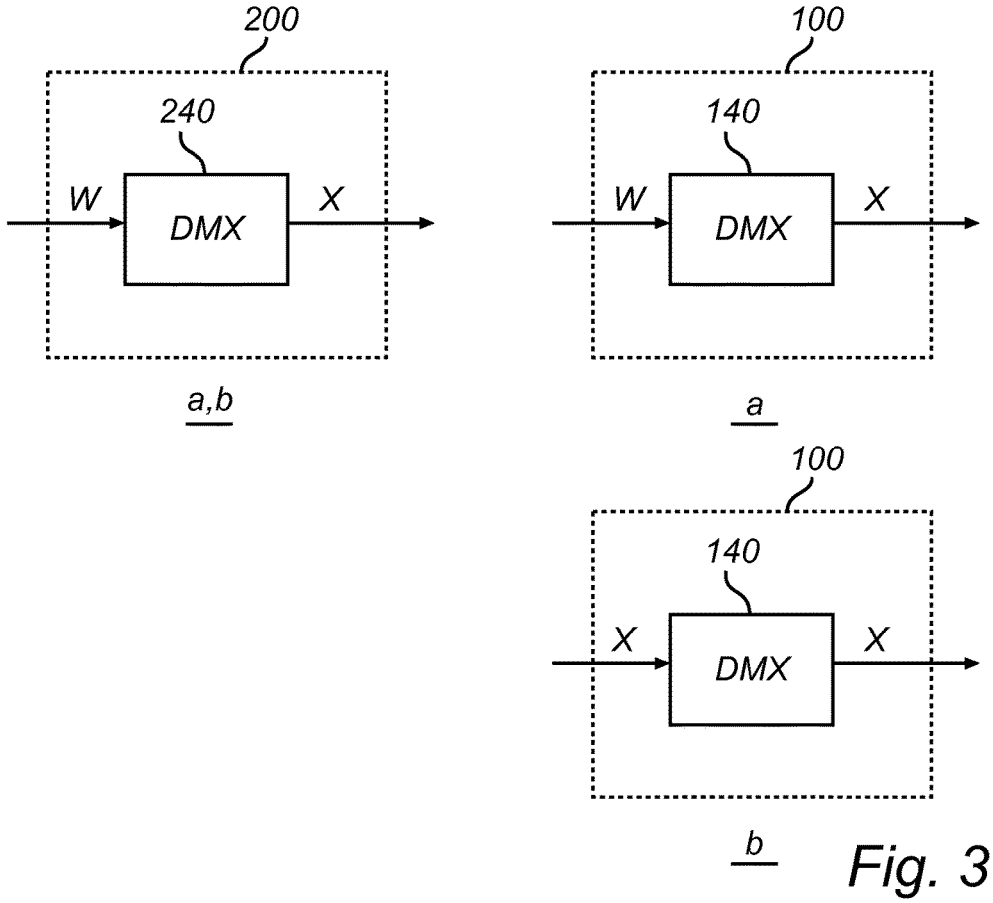
FIG. 3 illustrates the functioning of downmix stages located on the encoder and the decoder side.

Referring to FIG. 3, the downmix stage 240 located in the encoding system 200 receives an n-channel signal representation W of an audio signal and outputs (when it is activated by the selector 230) an m-channel downmix signal X in accordance with a downmix specification. (It should be noted that the downmix stage 240 may also output mixing parameters as previously described with reference to FIG. 2.) The downmix stage 140 located in the decoding system 100 also outputs an m-channel downmix signal X, and in accordance with an identical downmix specification. However, the input to this downmix stage 140 may represent an audio signal either as n discretely encoded channels W or by parametric coding. When the bitstream P represents the audio signal by parametric coding, the bitstream P contains a core signal which passes through the downmix stage 140 unchanged and becomes the downmix signal X. In parametric coding, the core signal is represented in n-channel format (with n−m channels that are present but not used), while the downmix signal is an m-channel signal. In reduced parametric coding, both the core signal and the downmix signal are in m-channel format, so that no format change is needed; instead, the downmix stage 140 may be deactivated and the signal may be supplied to the spatial synthesis stage 150 over a line arranged in parallel with the downmix stage 140.

Figure 5:
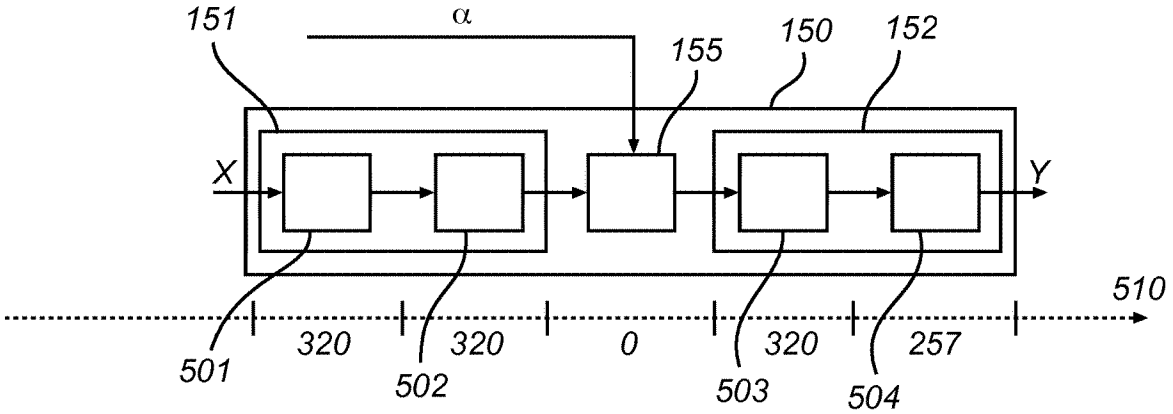
FIG. 5 shows details of a spatial synthesis stage according to an example embodiment for deployment in a decoding system.

Referring now to FIG. 5, the spatial synthesis stage 150 of FIG. 1 may comprise the following units, listed in the order from upstream to downstream: a first transform unit 501, a first transform modifier 502, an upmix stage 155, a second transform modifier 503 and a second transform unit 504.

The first transform unit 501 receives a time-domain representation of the m-channel downmix signal X and transforms it into a real-valued frequency-domain representation. The transform unit 501 may utilize for example a real-valued QMF analysis bank. The first transform modifier 502 converts this real-valued frequency-domain representation into a partially complex frequency-domain representation in order to improve the performance of the decoding system, e.g., by reducing aliasing effects that may appear if processing is performed on transformed signals which are critically sampled. The complex frequency-domain representation of the downmix signal X is supplied to the upmix stage 155. The upmix stage 155 receives at least one mixing parameter $\alpha$ and outputs a frequency-domain representation of the n-channel representation Y of the audio signal. The mixing parameter $\alpha$ may be included in the bitstream together with the core signal. The second transform modifier 503 modifies this signal into a real-valued frequency-domain representation of the n-channel representation Y of the audio signal, e.g., by updating real spectral data on the basis of imaginary spectral data so as to reduce aliasing, and supplies it to the second transform unit 504. The second transform unit 504 outputs a time-domain representation of the n-channel representation Y of the audio signal as output of the spatial synthesis stage 150.

In this example embodiment, each time frame consists of 1536 time-domain samples. Because all processing steps cannot be performed on one time-domain sample at a time, the units in the spatial synthesis stage may be associated with different (algorithmic) delays indicated on a time axis 510 in FIG. 5. The delay incurred may then be 320 samples for the first transform unit 501, 320 samples for the first transform modifier 502, 0 samples for the upmix stage 155, 320 samples for the second transform modifier 503 and 257 samples for the second transform unit 504. As previously described with reference to FIG. 1, a second delay line 160 may be introduced further downstream of the spatial synthesis stage 150 in a location where it delays both processing paths in the decoding system 100. The delay incurred by the second delay line 160 may be chosen to be 319 samples, whereby the combined delay of the spatial synthesis stage 150 and second delay 160 line is 1536 samples, i.e., the length of one time frame.

Table 1 lists those combinations of different modes of operation of different parts or aspects of an example embodiment (of a first type) of the decoding system 100 which may arise in a time frame. With reference to FIG. 1, at least one mixing parameter $\alpha$ is received by the spatial synthesis stage 155 when the input signal encodes the audio signal by parametric coding. The use of mixing parameters in the spatial synthesis stage 150 is referred to as aspect 1. The operation of the spatial synthesis stage 150 is referred to as aspect 2. The modes of the decoding system 100 as a whole are referred to as aspect 3. Assuming for the sake of this example that a time frame is split into 24 QMF slots of 64 samples each, the number of such slots in which mixing parameters are used is indicated as aspect 4.

TABLE 1

| Available modes of operation, FIG. 5 | |
|---|---|
| Aspect 1 | E (extrapolate), N (normal), K (keep) |
| Aspect 2 | R (reset), N (normal) |
| Aspect 3 | PM (parametric mode), PM→DM, DM (discrete mode), DM→PM |
| Aspect 4 | 0 (none), 24 (full) |

In the table and later in FIGS. 6 and 8, R (reset) refers to emptying an overlap-add buffer in the spatial synthesis stage 150; E (extrapolate) refers to backward extrapolation by a constant value; K (keep) refers to forward extrapolation by a constant value; N (normal) refers to inter-frame interpolation using the explicit values defined for the (non-initial) reference points in respective pairs of consecutive frames.

Depending on the coding of the audio signal in the input signal received by the encoding system 100, the aspects listed in Table 1 will be operating as listed. In the present embodiment, the modes of operation depend only on the coding regime in the current time frame and in the previous time frame as listed in Table 2, where N represents the current time frame and N−1 represents the previous time frame.

TABLE 2

| FSM programming/Received time frame combinations vs. combinations of modes of operation | | | | |
|---|---|---|---|---|
| Time frame | Coding regimes in time frames N and N-1 | | | |
| N | D | D | P | P |
| N-1 | D | P | D | P |
| Aspect 1 | N/A | K | E | N |
| Aspect 2 | N/A | N | R | N |
| Aspect 3 | DM | PM→DM | DM→PM | PM |
| Aspect 4 | 0 | 24 | 24 | 24 |

The decoding system's behaviour described by Table 2 may be controlled by a controller 170 communicatively connected to and controlling the spatial synthesis stage 150 and the mixer 130.

Figure 6:
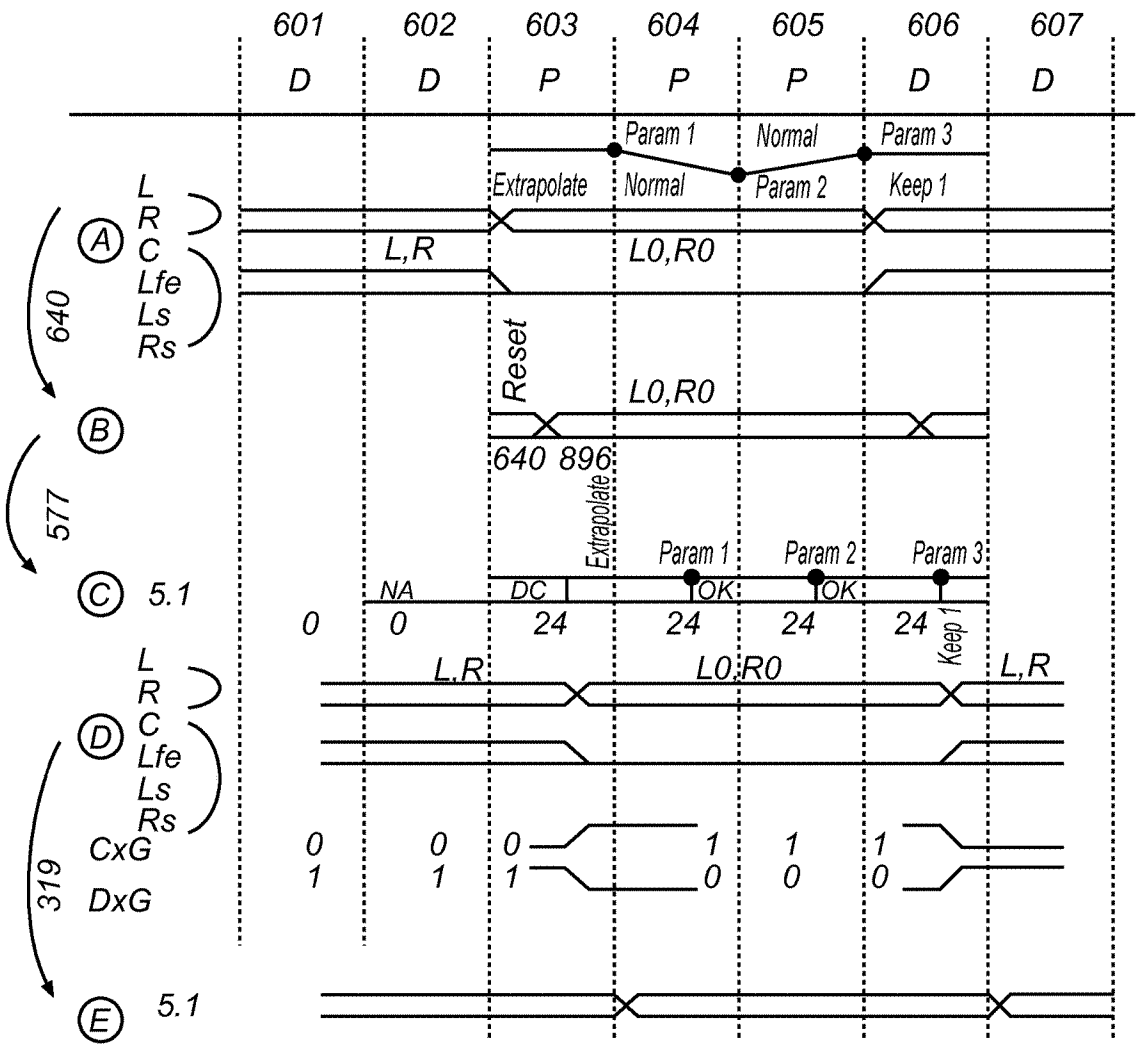
FIG. 6 illustrates data signals and control signals arising in an example decoding system equipped with the spatial synthesis stage of FIG. 5.

FIG. 6 illustrates data signals and control signals arising in an example decoding system 100 when the decoding system 100 receives an example input signal. FIG. 6 is divided into seven time frames 601 through 607, for which the coding regime is indicated below each reference number (discrete: D; parametric: P, like in the top portion of Table 2). The symbols Param1, Param2, Param3 refer to explicit mixing parameter values and their respective anchor points, which in this example embodiment is the right endpoint of a time frame.

The data signals originate from the locations indicated by encircled letters A through E in FIG. 1. The input signal A may in discrete coding regime be a representation of the audio signal as 5.1 surround with channels L (left), R (right) in an upper portion and C (center), Lfe (low frequency effects), Ls (left surround), Rs (right surround) in a lower portion. In parametric coding regime, however, the L and R channels are used to transmit core signal channels L0 (core left) and R0 (core right). Channels C, Lfe, Ls and Rs are present but not occupied in the parametric coding regime, so that the signal is formally in 5.1 format. Signal A may be supplied by the audio decoder 110. Signal B is a frequency-domain representation of the core signal, which is output by the first transform stage 151 in parametric mode but is preferably not generated in discrete mode to save processing resources. Signal C (not to be confused with the centre channel in signal A) is an upmixed signal received from the spatial synthesis stage 150 in parametric mode. Signal D is a delayed version of the input signal A, wherein the channels have been grouped as for signal A, and wherein the delay matches the pass-through time in the upper processing path in FIG. 1, the one including the spatial synthesis stage 150. Signal E is a delayed version of the mixer 130 output. Furthermore, FIG. 6 semi-graphically indicates the time values of control signals relating to the gain C×G applied to signal C by the mixer 130 and the gain D×G applied to signal D by the mixer 130; clearly, the gains assume values in the interval[0,1], and there are cross-mixing transitions during frame 603 and from frame 606. FIG. 6 is abstract in that it shows signal types (or signal regimes) while leaving signal values, primarily values of data signals, implicit or merely suggested.

FIG. 6 is annotated with the delays that separate the signals, in the form of curved arrows on the left side.

The different modes of operation listed in Tables 1 and 2 will now be described with reference to FIG. 6.

When the input signal is discretely coded in a current time frame 602 and a previous time frame 601 (first column of Table 2), the decoding system 100 is in a discrete mode (aspect 3: DM). The spatial synthesis stage 150 and mixing parameters are not needed (aspects 1 and 2: not applicable). Mixing parameters are not used in any portion of the present time frame 602 (aspect 4: 0). As shown in FIG. 6, the input signal A is a representation of the audio signal as 5.1 surround sound. The mixer 130 receives a delayed version D of the input signal and outputs this as the output E of the decoding system 100, possibly delayed by a second delay line 160 further downstream, as previously described with reference to FIG. 1.

When the input signal is discretely coded in a current time frame 606 and parametrically coded in a previous time frame 605 (second column of Table 2), the decoding system 100 transitions from a parametric mode to a discrete mode (aspect 3: PM→DM). Again, by virtue of the downmix stage 140 properties, which are controllable by the downmix specification, it is possible at all times across the parametric-to-discrete mode transition to obtain a stable core signal, and the mode transition can be carried out in a near unnoticeable fashion. The spatial synthesis stage 150 has received mixing parameters associated with the previous time frame. These are kept (aspect 1: K) during the current time frame, since there may be no new mixing parameters received that could serve as a second reference value for inter-frame interpolation. The spatial synthesis stage 150 receives a signal which transitions from being the core signal, of a parametrically coded signal received by the encoding system 100 as input signal A, to being a downmix signal of the discretely coded input signal A. The spatial synthesis stage 150 continues normal operation (aspect 2: N) from the previous time frame 605 during the current time frame 606. The mixing parameters are used during the whole time frame (aspect 4: 24). During the current time frame 606, the mixer 130 transitions from outputting the upmixed signal C received from the spatial analysis stage 150 to outputting the delayed version D of the input signal. As a consequence, the output E of the decoding system 100 transitions (during the next time frame 607 because of a delay of 319 samples incurred by the second delay line 160) from a reconstructed version, created by parametrically upmixing a downmixed signal, of the audio signal to a true multichannel signal representing the audio signal by n discretely encoded channels.

When the input signal is parametrically coded in a current time frame 603 and discretely coded in a previous time frame 602 (third column in Table 2), the decoding system 100 transitions from a discrete mode to a parametric mode (aspect 3: DM→PM). As this time frame 603 illustrates, even if there is in principle no coexistence of the core signal and the discretely coded channels, any discontinuities in connection with the regime change (between parametric and discrete coding) in the input signal are mitigated or avoided altogether, because the system has access to a stable core signal across the transition. The spatial synthesis stage 150 receives mixing parameters associated with the current time frame 603 at the end of the frame. Since there are no mixing parameters available for the previous time frame 602, the new parameters are extrapolated backward (aspect 1: E) to the entire current time frame 603 and used by the spatial synthesis stage 150. Since the spatial synthesis stage 150 has not been active in the previous time frame 602, it starts the current time frame 603 by resetting (aspect 2: R). The mixing parameters are used during the whole time frame (aspect 4: 24). The portion denoted "DC" (don't care) of signal C does not contribute to the output since the gain C×G is zero; the portion denoted "Extrapolate" is generated in the spatial synthesis stage 150 using extrapolated mixing parameter values; the portions denoted "OK" are generated in the normal fashion, using momentary mixing parameters that have been obtained by inter-frame interpolation between explicit values; and the portion "Keep1" is generated by maintaining the latest explicit mixing parameter value (from the latest parametrically coded time frame 605) and letting it control the quantitative properties of the spatial synthesis stage 150. Time frame 603 is but one example where such extrapolation occurs. Hence, during the current time frame 603, the mixer 130 transitions from outputting the delayed version C of the input signal to outputting the upmixed signal C received from the spatial analysis stage 150. As a consequence, the output E of the decoding system 100 transitions (during the next time frame 604 because of a delay of 319 samples incurred by the second delay line 160) from a true multichannel signal representing the audio signal by n discretely encoded channels to a reconstructed version, created by upmixing a downmixed signal, of the audio signal.

When the input signal is parametrically coded in a current time frame 605 and a previous time frame 604 (fourth column of Table 2), the decoding system is in a parametric mode (aspect 3: PM). The spatial synthesis stage 150 has received values, associated with the previous time frame, of the mixing parameters and also receives values, associated with the current time frame, of the mixing parameters, enabling normal frame-wise interpolation which provides the momentary mixing parameter values that control, inter alia, the gains applied during upmixing. This concludes the discussion relating to FIGS. 5 and 6 and Tables 1 and 2.

Figure 7:
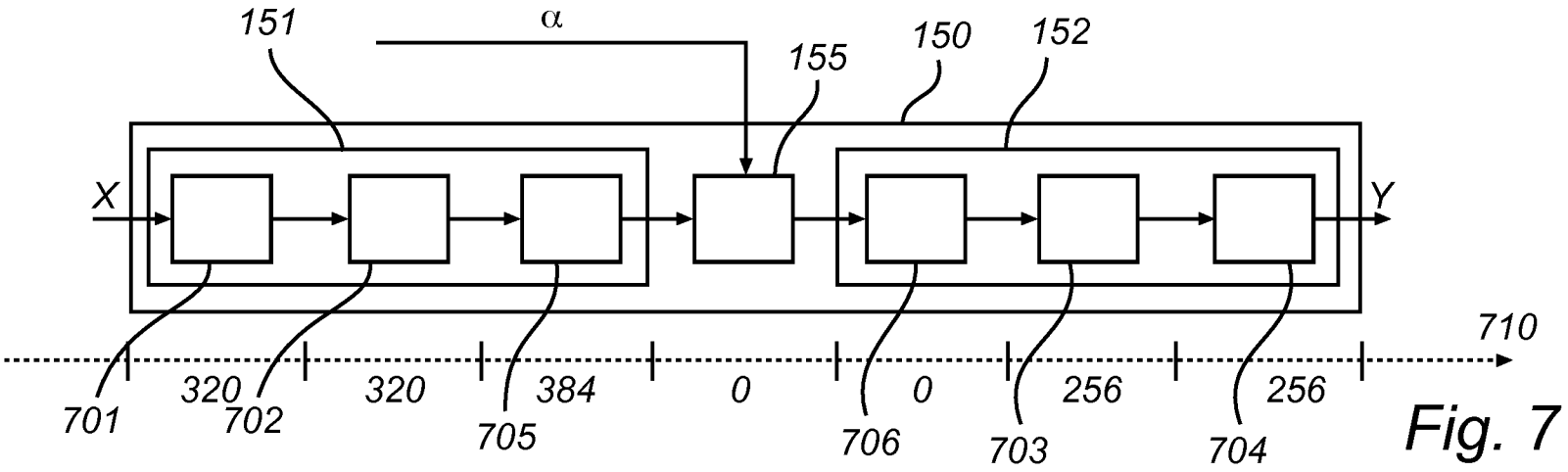
FIG. 7 shows details of a spatial synthesis stage according to an example embodiment for deployment in a decoding system.

Referring now to FIG. 7, there is shown a detail of a decoding system 100 having a hybrid filterbank, in accordance with a further example embodiment. In some applications, the increased resolution of the hybrid filter bank may be beneficial. According to FIG. 7, the first transform stage 151 in the spatial synthesis stage 150 comprises a time-to-frequency transform unit 701 (such as a QMF filter bank) followed by a real-to-complex conversion unit 702 and a hybrid analysis unit 705. Downstream of the first transform stage 151, there is an upmix stage 155 followed by the second transform stage 152, which comprises a hybrid synthesis unit 706, a complex-to-real conversion unit 703 and a frequency-to-time transform unit 704 arranged in this sequence. The respective pass-through times (in samples) are indicated below the dashed line 710; pass-through time zero is to be understood as sample-wise processing, wherein the algorithmic delay is zero and the actual pass-through time can be made arbitrarily low by allocating sufficient computational power. The presence of the hybrid analysis and synthesis stages 705, 706 constitutes a significant difference in relation to the previous example embodiment. The resolution is higher in the present embodiment, but the delay is longer and a controller 170 (or finite state machine) needs to handle a more complicated state structure (as shown below in Table 4) if it is to control the encoding system 100. As Table 3 indicates, the available operational modes of these units are similar to the previous case:

TABLE 3

| Available modes of operation, FIG. 7 | |
|---|---|
| Aspect 1 | E (extrapolate), N (normal), K (keep) |
| Aspect 2 | R (reset), N (normal) |
| Aspect 3 | PM (parametric), PM→DM, DM (discrete), DM→PM |
| Aspect 4 | 0 (none), 4 (flush), 24 (full) |

Reference is made to Table 1 and the subsequent discussion for further explanations. The new flush mode (in aspect 4) enables a time-domain cross fade from parametric n-channel output to discrete n-channel output.

As shown in below Table 4, a decoding system 100 according to the present example embodiment is controllable by a controller 170 (or finite state machine), the state of which is determined by the combination of the coding regimes (discrete or parametric) in the two time frames received before a current time frame. Using the same notation as in Table 2, the controller (or finite state machine) may be programmed as follows:

TABLE 4

| FSM programming/Received time frame combinations vs. combinations of modes of operation | | | | | | | | |
|---|---|---|---|---|---|---|---|---|
| Time frame | Coding regimes in the time frames N, N − 1 and N − 2 | | | | | | | |
| N | D | D | D | D | P | P | P | P |
| N − 1 | D | D | P | P | D | D | P | P |
| N − 2 | D | P | D | P | D | P | D | P |
| Aspect 1 | N/A | K | K | K | E | E | N | N |
| Aspect 2 | N/A | N | N | N | R | N | N | N |
| Aspect 3 | DM | PM→DM | DM→PM | PM | DM | PM→DM | DM→PM | PM |
| Aspect 4 | 0 | 4 | 24 | 24 | 24 | 24 | 24 | 24 |

Figure 8:
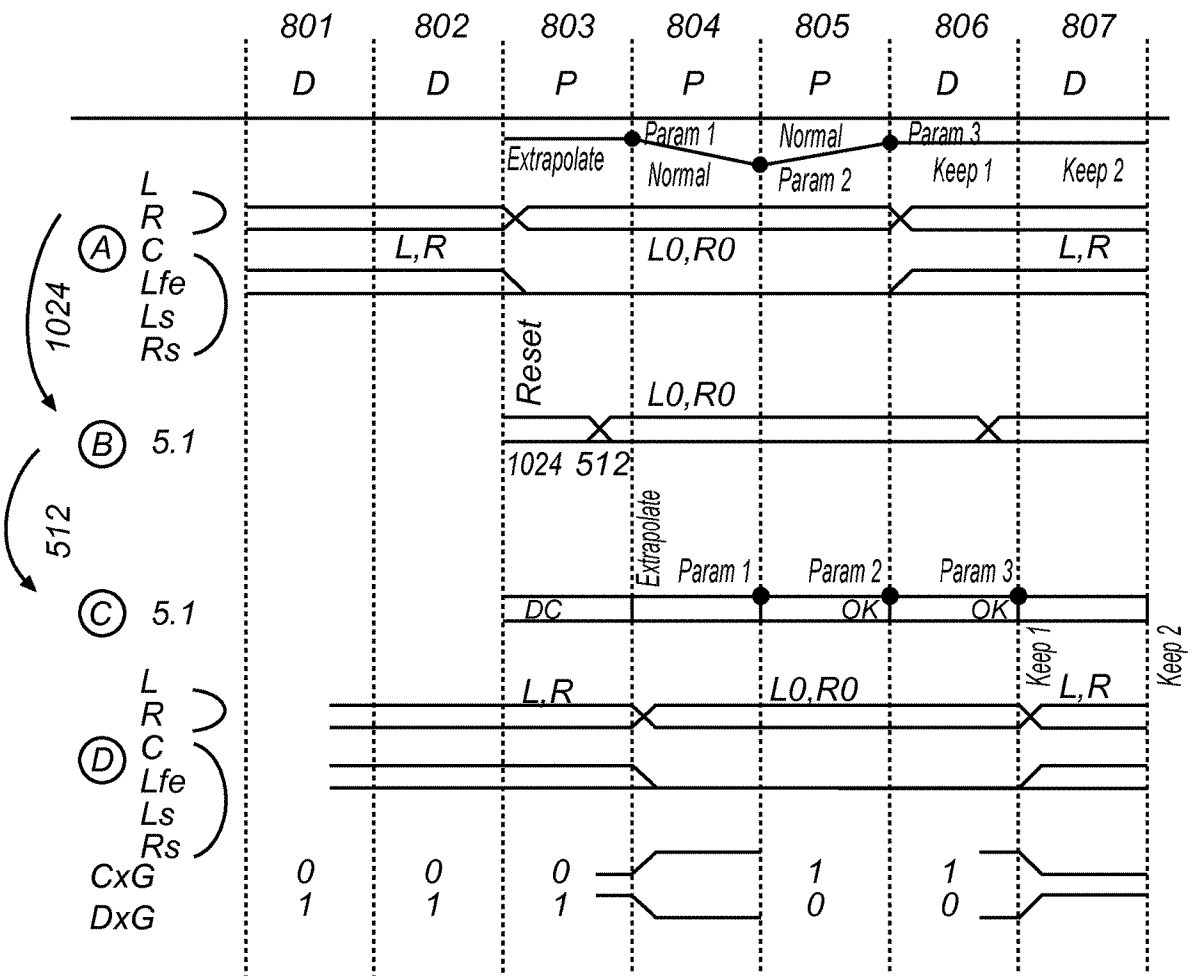
FIG. 8 illustrates data signals and control signals arising in an example decoding system equipped with the spatial synthesis stage of FIG. 7.

The application of the programming scheme in Table 4 is illustrated by FIG. 8, which visualizes data signals A through D, to be observed at the locations indicated by encircled letters A through D in FIG. 1, as functions of time over seven consecutive time frames 801 to 807.

The above discussion relating to the discrete decoding mode, the parametric decoding mode and the discrete-to-parametric transition illustrated in FIG. 6 applies, with appropriate adjustments, to the situation illustrated in FIG. 8 as well. One notable difference is due to the greater algorithmic delay in the parametric decoding computations in the present embodiment (1536 samples rather than 1217 samples). In decoding systems having an algorithmic delay of more than 1536 samples, a parametric-to-discrete transition may occupy one additional time frame. Hence, in order to provide the signal C for (a fraction of) a further time frame, the latest received explicit mixing parameter value may need to be forward extrapolated over two time frames, as suggested by "Keep1", "Keep2", so that cross fade may take place. In conclusion, still with reference to a decoding system where the algorithmic delay exceeds 1536 samples or an entire frame, the transition from parametric to discrete decoding mode is triggered by a coding regime change in the input signal from a parametric episode to a discrete episode, wherein the latest explicit mixing parameter value is forward extrapolated (kept) up to the end of two time frames after the associated time frame, wherein the decoding system enters discrete mode in the second time frame after the first received discretely coded time frame.

There will now be described a decoding system having a spatial synthesis stage with the general structure as in FIG. 5 (and consequently, the same algorithmic delay values as indicated in FIG. 6) but with the ability to process an input signal which is in a reduced parametric regime. The properties of the reduced parametric coding regime have been outlined above, including its differences with respect to the parametric and discrete coding regimes.

Figure 11:
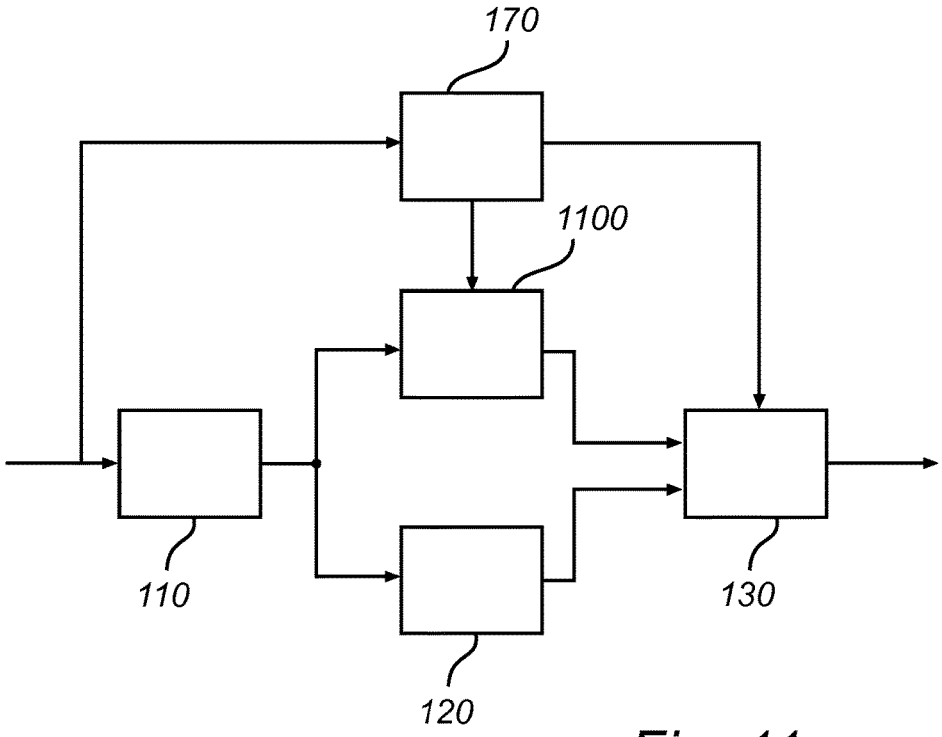
FIG. 11 is a generalized block diagram of a decoding system in accordance with an example embodiment of the invention.

In the decoding system to be considered here, there is provided a controller 170 with the additional responsibility of controlling the operation of the downmix stage 140. In FIG. 1, this is suggested by the dashed arrow from the controller 170 to the downmix stage 140. The present decoding system may be said to be organized according to the functional structure shown in FIG. 11, wherein an input signal to the system is supplied to both the audio decoder 110 and the controller 170. The controller 170 is configured to control, based on the detected coding regime of the input signal, each of the mixer 130 and a parametric multichannel decoder 1100, in which the downmix stage (not shown in FIG. 11) and the spatial synthesis stage (not shown in FIG. 11) are comprised. The mixer 130 receives input from the parametric multichannel decoder 1100 and from the first delay line 120, each of which base their processing on data extracted by the audio decoder 110 from the input signal. In order for the decoding system to benefit from the reduced parametric coding regime, the controller 170 is operable to deactivate the downmix stage in the parametric multichannel decoder 1100. Preferably, the downmix stage is deactivated when the input signal is in the reduced parametric regime, when the core signal to be supplied to the spatial synthesis stage is represented in m-channel format (rather than n-channel format, as in the regular parametric mode). Even if, as noted, those signals in the n-channel format which represent the core signal pass through the downmix stage unchanged, the fact that the core signal can be supplied directly to the spatial synthesis stage without any need for conversion between n-channel format and m-channel format implies a potential saving in computational resources.

Because the controller 170 is also adapted to control the downmix stage 140, the table of available modes in the decoding system is extended with respect to Table 1 above:

TABLE 5

Figure 10:
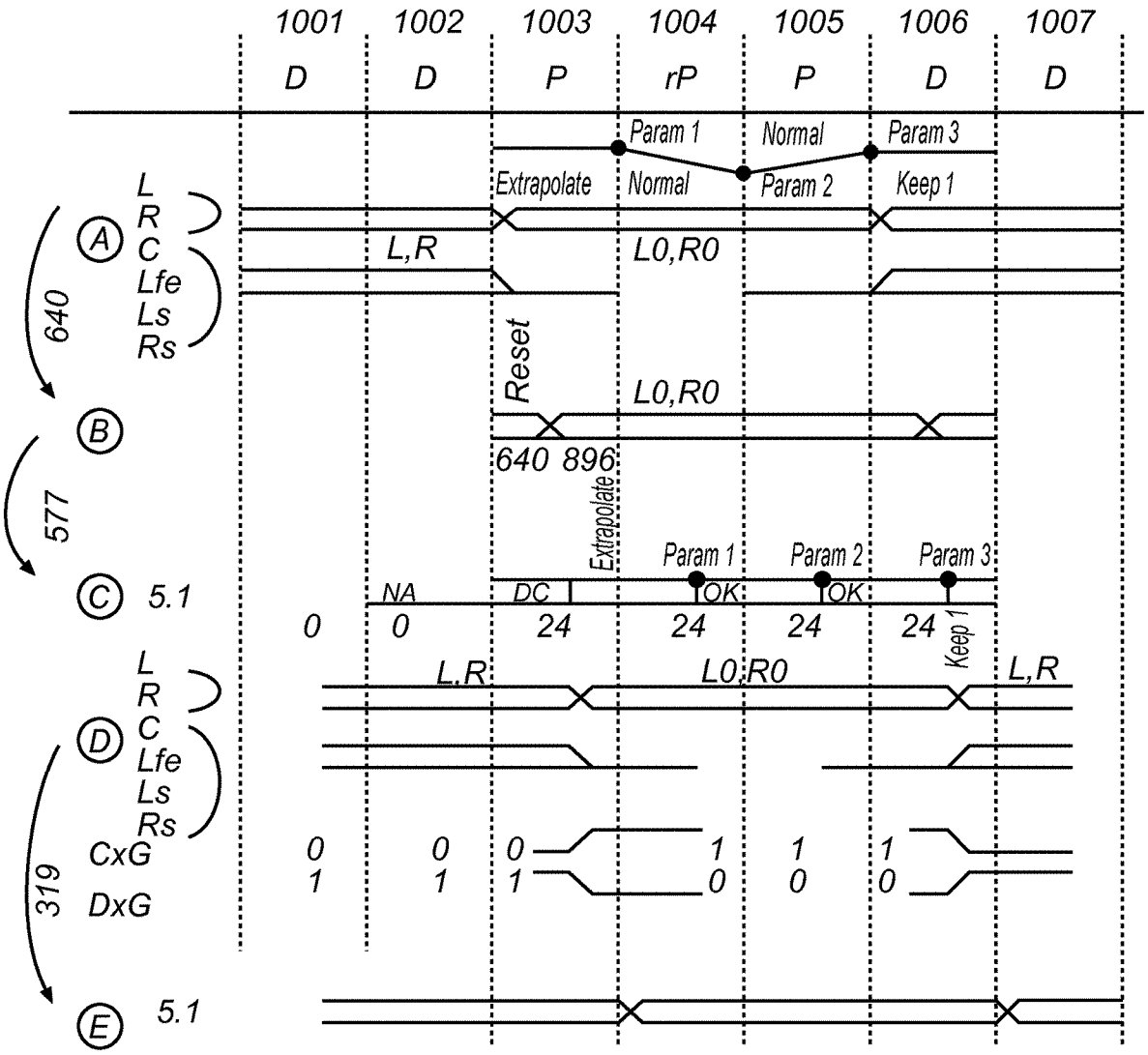
FIG. 10 illustrates data signals and control signals arising in an example decoding system equipped with the spatial synthesis stage of FIG. 5.

| Available modes of operation, FIG. 10 | |
|---|---|
| Aspect 1 | E (extrapolate), N (normal), K (keep) |
| Aspect 2 | R (reset), N (normal), NDB (normal, downmix bypassed) |
| Aspect 3 | PM (Parametric), PM→DM, DM (Discrete), DM→PM |
| Aspect 4 | 0 (none), 24 (full) |

The R (reset) and N (normal) modes under aspect 2 are as previously defined. In the new NDB (normal, downmix bypassed) mode, the downmix stage 140 is deactivated, and the core signal is supplied to the spatial synthesis stage 150 without a format conversion involving a change in the number of channels.

The state of the controller 170 is still uniquely determined by the combination of the coding regimes in the current and the previous time frame. The presence of the new coding regime increases the size of the FSM programming table in comparison with Table 2:

TABLE 6

| FSM programming/Received time frame combinations vs. combinations of modes of operation | | | | | | | |
|---|---|---|---|---|---|---|---|
| Time frame | Coding regimes in time frames N and N − 1 | | | | | | |
| N | D | D | P | P | P | rP | rP |
| N − 1 | D | P | D | P | rP | rP | P |
| Aspect 1 | N/A | K | E | N | N | N | N |
| Aspect 2 | N/A | N | R | N | N | NDB | NDB |
| Aspect 3 | DM | PM→DM | DM→PM | PM | PM | PM | PM |
| Aspect 4 | 0 | 24 | 24 | 24 | 24 | 24 | 24 |

Table 6 does not treat the two cases (D, rP) and (rP, D), which are not expected to occur except in a failure state of the system according to this example embodiment. Some implementations may further exclude the case (P, P) referred to in the $4^{th}$ column (or regard this case as a failure) since it may be more economical to have the input signal switch to rP regime as soon as possible. However, if the encoder is configured for very fast switching, two discretely coded episodes may be separated by a very small number of time frames belonging to the other coding regimes, and it may turn out necessary to accept (P, P) as a normal case. Put differently, very short parametric episodes may be occupied by the portions necessary to achieve smooth switching to the extent that the encoding system does not have time to enter a reduced parametric encoding mode.

With reference to FIG. 10, the decoding system is in the mode corresponding to the $1^{st}$ or $2^{nd}$ column of Table 6 in time frame 1001; it is in the mode corresponding to the $1^{st}$ column in time frame 1002; it is in the mode corresponding to the $3^{rd}$ column in time frame 1003; it is in the mode corresponding to the $7^{th}$ column in time frame 1004; it is in the mode corresponding to the $5^{th}$ column in time frame 1005; it is in the mode corresponding to the $2^{nd}$ column in time frame 1006; and it is in the mode corresponding to the $1^{st}$ column in time frame 1007. In this example, time frame 1004 is the only time frame in which the received input signal is in the reduced parametric regime. In a more realistic example, however, an episode of time frames in reduced parametric coding regime is typically longer, occupying a larger number of time frames than the parametrically coded time frames at its endpoints, which are relatively fewer. A more realistic example of this type will illustrate the mode which the decoding system enters in response to receipt of two consecutive rP, rP coded time frames, corresponding to the $6^{th}$ column of Table 6. However, since the $6^{th}$ and $7^{th}$ columns in the table do not differ as far as aspects 1-4 are concerned, it is believed that the skilled person will be able to understand and implement the desirable behaviour of the decoding system in such a time frame by studying FIG. 10 and the above discussion.

It is noted in closing that Tables 5-6 and FIG. 10 could have been derived equally well with Tables 3-4 and FIGS. 7-8 as a starting point. Indeed, while the decoding system illustrated therein is associated with a greater algorithmic delay, the ability of receiving and processing an input signal in reduced parametric coding regime may be implemented substantially in the same manner as described above. If the algorithmic delay exceeds one time frame, however, the state of the controller 170 in the decoding system will be determined by the coding regime in the current time frame and two previous time frames. The total number of possible controller states will be $3^3=27$, but a substantial number of out these (including any three-frame sequence including (rP, D) or (D, rP)) may be left out of consideration since they will only appear as a consequence of an encoder-side failure. It is emphasized that the last statement applies primarily to the example embodiment described hereinabove and does not relate to an essential limitation of the invention as such. Indeed, an embodiment capable of reconstructing an audio signal based on an arbitrary sequence of reduced parametrically and discretely (and possibly also parametrically) time frame will be discussed below after the description of FIG. 12.

Figure 12:
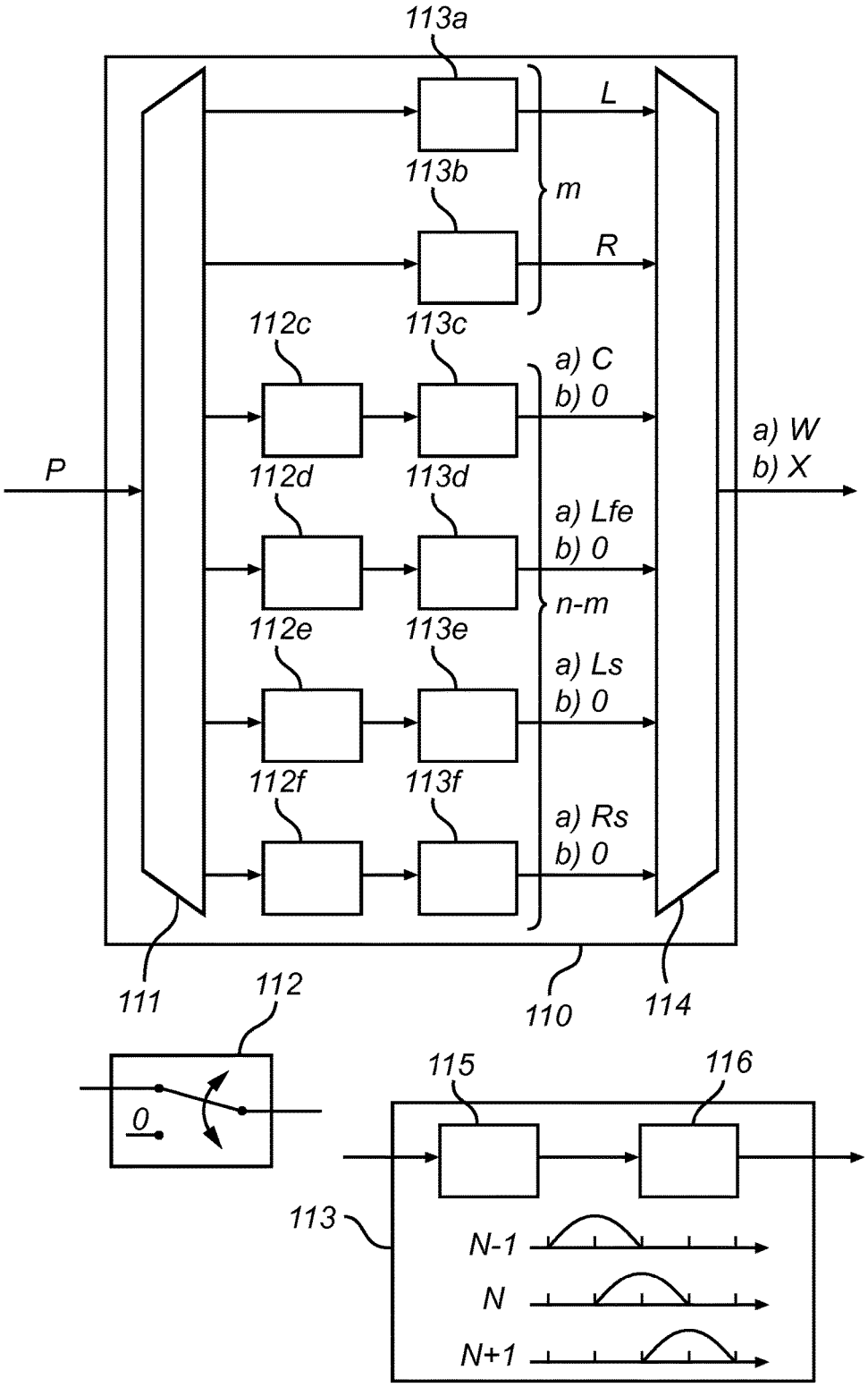
FIG. 12 shows details of an audio decoder according to an example embodiment for deployment in a decoding system.

FIG. 12 shows a possible implementation of the audio decoder 110 forming part of the decoding system 100 of FIG. 1 or similar decoding systems. The audio decoder 110 is adapted to output a time-domain representation of an input signal W, X on the basis of an incoming bitstream P. For this purpose, a demultiplexer 111 extracts channel substreams (each which may be regarded as a frequency-domain representation of a channel in the input signal) from the bitstream P which are associated with each of the channels in the input signal W, X. The respective channel substreams are supplied, possibly after additional processing, to a plurality of channel decoders 113, which provide each of the channels L, R, . . . of the input signal. Each of the channel decoders 113 preferably provides a time value of the associated channel by summing contributions from at least two windows which overlap at the current point in time. This is the case of many Fourier-related transforms, in particular MDCT; for example, one transform window may be equivalent to 512 samples. The inner workings of a channel decoder 113 are suggested in the lower portion of the drawing: it comprises an inverse transform section 115 followed by an overlap-add section 116. In some implementations, the inverse transform section 115 may be configured to carry out an inverse MDCT. The three plots labelled N−1, N and N+1 visualize the output signal from the inverse transform section 115 for three consecutive transform windows. In the time period where the $(N-1)^{th}$ and $N^{th}$ transform windows overlap, the overlap-and-add section 116 forms the time values of the channel by adding the inversely transformed values within the $(N-1)^{th}$ and $N^{th}$ transform windows. In the subsequent time period, similarly, the time values of the channel signal are obtained by adding the inversely transformed values pertaining to the $N^{th}$ and $(N+1)^{th}$ transform windows. Clearly, the $(N-1)^{th}$ and $N^{th}$ transform windows will originate from different time frames of the input signal in the vicinity of a time frame border. Returning to the main portion of FIG. 12, a combining unit 114 located downstream of the channel decoders 113 combines the channels in a manner suitable for the subsequent processing, e.g., by forming time frames each of which includes the necessary data for reconstructing all channels in that time frame.

As stated, the audio signal may be represented either (b) by parametric coding or (a) as n discretely encoded channels W (n>m). In parametric coding, while m signals are used to represent the audio signal, an n-channel format is used, so that n−m signals do not carry information or may be assigned neutral values, as explained above. In example implementations, this may imply that n−m of said channel substreams represent a neutral signal value. The fact that neutral signal values are received in the not-used channels is beneficial in connection with a coding regime change from parametric to discrete coding or vice versa. In the vicinity of such a coding regime change, two transform windows belonging to frames with different coding regimes will overlap and contribute to the time-representation of the channel. By virtue of the presence of the neutral values, however, the operation of summing the contributions will still be well-defined.

In some example embodiments, the decoding system 100 is further adapted to receive time frames of the input signal that are (c) reduced parametrically coded, wherein the input signal is in m-channel format. This means the n−m channels that carry neutral values in the parametric coding regime are altogether absent. To ensure smooth functioning of the channel decoders 113 also across a coding regime change, at least n−m of the channel decoders 113 are preceded by a pre-processor 112 which is shown in detail in the lower portion of FIG. 12. The pre-processor 112 is operable to produce a channel substream encoding neutral values (denoted "0"), which has been symbolically indicated by a selector switchable between a pass-through mode and a mode where the neutral value is output. The corresponding channel of the input signal W, X will contain neutral values on at least one side of the coding regime change.

The pre-processors 112 may be controllable by a controller 170 in the decoding system 100. For instance, they may be activated in such regime changes between (b) discrete coding and (c) reduced parametric coding where there is no intermediate parametrically coded time frame. Because the input signal W, X will be supplied to the downmix stage 140 in time frames which are adjacent to a discrete episode, it is necessary in such circumstances that the input signal be sufficiently stable. To achieve this, the controller 170 will respond to a detected regime change of this type by activating the pre-processors 112 and the downmix stage 140. The collective action of the pre-processors 112 is to append n−m channels to the input signal. From an abstract point of view, the pre-processors 112 achieve a format conversion from an m-channel format into an n-channel format (e.g., from acmod2 into acmod7 in the Dolby Digital Plus framework).

The audio decoder 110 which has been described above with reference to FIG. 12 makes it possible to supply a stable input signal—and hence a stable downmix signal—also across regime changes from reduced parametric coding into discrete coding and vice versa. Indeed, the decoding systems details of which are depicted in FIGS. 5 and 7 may be equipped with an audio decoder with the above characteristics. These systems will then be able to handle a time frame sequence of the type D D D rP rP . . . rP D D D by operating in accordance with FIGS. 6 and 8, respectively.

Turning to FIG. 6 specifically, the coding regime of time frames 603, 604 and 605 will be reduced parametric (rP). In time frame 603, the at least one pre-processor 112 in the audio decoder 110 is activated in order to reformat the signal into n-channel format, so that the downmix stage 140 will operate across the regime change (from L, R into L0, R0) without interruption. Preferably, the pre-processor is active only during an initial portion of the time frame 603, corresponding to the time interval where transform windows belonging to different coding regimes are expected to overlap. In time frame 604, the reformatting is not necessary, but the input signal A may be forwarded directly to the input side of the spatial synthesis stage 151 and the downmix stage 140 can be deactivated temporarily. However, because time frame 605 is the last one in the reduced parametric episode and contains at least one transform window having its second endpoint in the next frame, the audio decoder 110 is set in reformatting mode (pre-processors 112 active). In time frame 606 then, when the downmix stage 140 is activated, the change in content of the input signal A at the beginning of this time frame 606 will not be noticeable to the downmix stage 140 which will instead provide a discontinuous downmix signal X across the content change. Again, it is sufficient and indeed preferable for the pre-processors 112 to be active only during the last portion of time frame 605, in which is located the beginning of the transform window which will overlap with the first transform window of the first discretely coded time frame 606.

A similar variation of FIG. 8 is possible as well, wherein reduced parametrically coded data (rP) are received during time frames 803, 804 and 805. Suitably, and for the reasons noted in the previous paragraph and elsewhere, the format conversion functionality of the audio decoder 110 is active in (the beginning of) time frame 803 and (the end of) time frame 805, so that the decoder may supply a homogenous and stable signal to the downmix stage 140 at all times across the two regime changes. It is recalled that this example embodiment comprises a hybrid filterbank, but this fact is of no particular relevance to the operation of the audio decoder 110. Unlike e.g. the period during which the mixing parameters a need to be extrapolated, the duration of the potential signal discontinuity arising from the change in signal content is independent of the algorithmic delays in the system and remains localized in time on its way through the system. In other words, there is no need to operate the pre-processors 112 for longer periods of time in the example embodiment shown in FIG. 8 compared to FIG. 6.

III. Equivalents, Extensions Alternatives and Miscellaneous

Further embodiments of the present invention will become apparent to a person skilled in the art after studying the description above. Even though the present description and drawings disclose embodiments and examples, the invention is not restricted to these specific examples. Numerous modifications and variations can be made without departing from the scope of the present invention, which is defined by the accompanying claims. Any reference signs appearing in the claims are not to be understood as limiting their scope.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

What is claimed is:

1. A decoding system for reconstructing an n-channel audio signal, wherein the decoding system is adapted to receive a bit stream encoding an input signal segmented into time frames and representing the audio signal, in a given time frame, according to a coding regime selected from the group comprising:

b) discrete coding using n discretely encoded channels; and c) parametric coding of a first type using an m-channel core signal and at least one mixing parameter, wherein $n>m\geq 1$, the decoding system being operable to derive the audio signal either on the basis of said n discretely encoded channels or by spatial synthesis, the decoding system comprising:

an audio decoder adapted to extract a frequency-domain representation of the input signal from the bitstream and to transform it into a time-domain representation of the input signal;

a downmix stage operable to output an m-channel downmix signal based on the time-domain representation of the input signal in accordance with a downmix specification; and a spatial synthesis stage operable to output an n-channel representation of the audio signal based on said downmix signal and said at least one mixing parameter, wherein the audio decoder is further adapted to reformat the frequency-domain representation of the input signal into n-channel format by appending n–m neutral channels prior to transforming it into said time-domain representation, wherein the audio decoder is adapted to perform said reformatting for at least an initial portion of each first type parametrically coded time frame directly succeeding a discretely coded time frame and for at least a final portion of each first type parametrically coded time frame directly preceding a discretely coded time frame.

2. The decoding system according to claim 1, wherein the audio decoder is adapted to perform a time-to-frequency transform using overlapping transform windows, wherein each of said time frames is equivalent to the half-length of at least one of said transform windows.

3. The decoding system according to claim 1, wherein the audio decoder is adapted to determine, in each first type parametrically coded time frame directly succeeding a discretely coded time frame, at least one channel of the time-domain representation of the input signal by summing at least a first contribution, from at least one of said neutral channels of the first type parametrically coded time frame, and a second contribution, from the directly preceding discretely coded time frame.

4. The decoding system according to claim 1, wherein the audio decoder is adapted to determine, in each discretely coded time frame directly succeeding a first type parametrically coded time frame, at least one channel of the time-domain representation of the input signal by summing at least a first contribution, from the discretely coded time frame, and a second contribution, from at least one of said neutral channels of the directly preceding first type parametrically coded time frame.

5. The decoding system according to claim 1, wherein the downmix stage is adapted to be active in at least the first time frame in each episode of discretely coded time frames and in at least the first time frame after each episode of discretely coded time frames.

6. The decoding system according to claim 1, further comprising:

a first delay line adapted to receive the input signal; and a mixer communicatively connected to the spatial synthesis stage and the first delay line and being adapted to output, in a parametric mode of the system, the spatial synthesis stage output or a signal derived therefrom;

to output, in a discrete mode of the system, the first delay line output; and to output, in response to a change between first type parametric and discrete coding occurring in the input signal, a mixing transition between the spatial synthesis stage output and the first delay line output.

7. The decoding system according to claim 6, wherein the first delay line is operable to incur a delay corresponding to a total pass-through time associated with the downmix stage and the spatial synthesis stage.

8. The decoding system according to claim 7, further comprising a second delay line adapted to receive the mixer output, wherein the total delay incurred by the first and second delay lines corresponds to a multiple of the length of one time frame.

9. The decoding system according to claim 1, further comprising a controller for controlling the spatial synthesis stage and any mixer on the basis of coding regimes of a current time frame and a directly preceding time frame, or on the basis of coding regimes of a current time frame and two directly preceding time frames.

10. The decoding system according to claim 1, wherein the group of coding regimes further comprises a) parametric coding of a second type, the decoding system being adapted to receive a bitstream encoding an input signal comprising, in each time frame in which the input signal represents the audio signal by second type parametric coding, an m-channel core signal being such that, in each time frame in which the input signal represents the audio signal as n discretely encoded channels, an m-channel core signal representing the same audio signal is obtainable from the input signal using the downmix specification.

11. The decoding system according to claim 10, wherein the downmix stage is adapted to generate the downmix signal, in each time frame in which the input signal represents the audio signal by second type parametric coding and which is preceded by a first type parametrically coded time frame or a second type parametrically coded time frame, by reproducing the core signal of the parametric representation of the audio signal as the downmix signal.

12. The decoding system according to claim 10, wherein the decoding system is adapted to receive a bitstream encoding an input signal being, in each time frame in which the input signal represents the audio signal by second type parametric coding, an n-channel signal, in which n−m channels are not used to represent the audio signal.

13. A method of reconstructing an n-channel audio signal, the method comprising the steps of:

receiving a bitstream encoding an input signal segmented into time frames and representing the audio signal, in a given time frame, according to a coding regime selected from the group comprising:

b) discrete coding using n discretely encoded channels; and c) parametric coding of a first type using an m-channel core signal and at least one mixing parameter, wherein $n>m\geq 1$;

extracting a frequency-domain representation of the input signal from the bitstream;

in response to the input signal being first type parametrically coded in a current time frame and discretely coded in a directly preceding time frame, reformatting at least an initial portion of the current time frame of the frequency-domain representation of the input signal into n-channel format by appending n−m neutral channels to said m-channel core signal;

in response to the input signal being first type parametrically coded in a current time frame and discretely coded in a directly succeeding time frame, reformatting at least a final portion of the current time frame of the frequency-domain representation of the input signal into n-channel format by appending n−m neutral channels to said m-channel core signal;

transforming said frequency-domain representation of the input signal into a time-domain representation of the input signal;

in response to the input signal being discretely coded in a current and two directly preceding time frames, deriving the audio signal on the basis of said n discretely encoded channels; and in response to the input signal being first type parametrically coded in a current and two directly preceding time frames, generating an n-channel representation of the audio signal based the core signal and said at least one mixing parameter.

14. The method according to claim 13, comprising the steps of:

in response to the input signal being discretely coded in a current and a previous time frame, deriving the audio signal on the basis of said n discretely encoded channels; and in response to the input signal being first type parametrically coded in a current and a directly preceding time frame, generating an n-channel representation of the audio signal based on the core signal and the at least one mixing parameter.

15. The method according to claim 13, further comprising:

in response to a current time frame being the first time frame in an episode of discretely coded time frames, or the current time frame being the first time frame after an episode of discretely coded time frames, generating an m-channel downmix signal based on the input signal in accordance with a downmix specification.

16. The method according to claim 15, wherein each time frame of the input signal in which it represents the audio signal by first type parametric coding comprises a value of the at least one mixing parameter for a non-initial point in the given time frame, the method further comprising the step of:

in response to the input signal being discretely coded in the current time frame and first type parametrically coded in the previous time frame, generating an n-channel representation of the audio signal based on the downmix signal and based on at least one value, associated with the previous time frame, of the at least one mixing parameter and transitioning during the current time frame into deriving the audio signal on the basis of said n discretely encoded channels.

17. The method according to claim 13, wherein each time frame of the input signal in which it represents the audio signal by first type parametric coding comprises a value of the at least one mixing parameter for a non-initial point in the given time frame, the method further comprising the step of:

in response to the current time frame being the first time frame in an episode of first type parametrically coded time frames, backward extrapolating the received value of the at least one mixing parameter up to the beginning of the current time frame.

18. An encoding system for encoding an n-channel audio signal segmented into time frames, wherein the encoding system is adapted to output a bitstream representing the audio signal, in a given time frame, according to a coding regime selected from the group comprising:

a) parametric coding of a second type, b) discrete coding using n discretely encoded channels; and c) parametric coding of a first type, the encoding system comprising:

a selector adapted to select, for a given time frame, which encoding regime is to be used to represent the audio signal; and a parametric analysis stage operable to output, based on an n-channel representation of the audio signal and in accordance with a downmix specification, an m-channel core signal and at least one mixing parameter, which are to be encoded by the output bitstream in the first type parametric coding regime, wherein $n>m\geq 1$, an n-channel signal format is used in the second type parametric and discrete coding regimes, and an m-channel signal format is used in the first type parametric coding regime.

19. A method of encoding an n-channel audio signal as a bitstream, the method comprising the steps of:

receiving an n-channel representation of the audio signal;

selecting a coding regime, from the group comprising:

a) parametric coding of a second type, b) discrete coding using n discretely encoded channels; and c) parametric coding of a first type, to be used to represent the audio signal, in a given time frame;

in response to a selection to encode the audio signal by first type parametric coding, forming, based on the n-channel representation of the audio signal and in accordance with a downmix specification, a bitstream encoding an m-channel core signal and at least one mixing parameter, wherein $n>m\geq 1$, an n-channel signal format is used in the second type parametric and discrete coding regimes, and an m-channel signal format is used in the first type parametric coding regime; and in response to a selection to encode the audio signal by discrete coding, outputting a bitstream encoding the audio signal by n discretely encoded channels.

* * * * *